US012630972B2

(12) United States Patent
Kawamura

(10) Patent No.: US 12,630,972 B2
(45) Date of Patent: May 19, 2026

(54) FABRIC TREATMENT AGENT, FABRIC PRINTING METHOD, FABRIC PRINTING APPARATUS, AND PRINTED FABRIC

(71) Applicant: Konica Minolta, Inc., Tokyo (JP)

(72) Inventor: Ayumi Kawamura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 207 days.

(21) Appl. No.: 18/462,097

(22) Filed: Sep. 6, 2023

(65) Prior Publication Data

US 2024/0117565 A1 Apr. 11, 2024

(30) Foreign Application Priority Data

Sep. 15, 2022 (JP) ..... 2022-147091

(51) Int. Cl.
*D06P 5/28* (2006.01)
*D06P 1/642* (2006.01)

(52) U.S. Cl.
CPC ..... *D06P 5/006* (2013.01); *D06P 1/6426* (2013.01); *D10B 2201/01* (2013.01)

(58) Field of Classification Search
CPC ..... D06P 5/006; D06P 1/6426; D06P 3/34; D10B 2201/01
See application file for complete search history.

(56) References Cited

U.S. PATENT DOCUMENTS

2008/0006176 A1* 1/2008 Houjou ..... B41J 2/01 106/31.13

FOREIGN PATENT DOCUMENTS

| | | | | | |
|---|---|---|---|---|---|
| CN | 105899620 | A | * | 8/2016 | ..... G03G 9/0906 |
| CN | 111655804 | A | * | 9/2020 | ..... C09D 133/066 |
| CN | 110248816 | B | * | 6/2021 | ..... B41M 5/0011 |
| EP | 2740772 | A1 | * | 6/2014 | ..... D06P 5/30 |
| JP | H07-216763 | A | | 8/1995 | |
| JP | 2012153754 | A | * | 8/2012 | |
| JP | 2014125682 | A | * | 7/2014 | |
| WO | WO-2020162872 | A1 | * | 8/2020 | ..... D06P 5/2005 |

OTHER PUBLICATIONS

English machine translation of Yoshihiki et al. (CN 105899620 A) (Year: 2016).*
English machine translation of Masahiro et al. (CN 110248816 A) (Year: 2021).*
English machine translation of Shoichiro et al. (CN 111655804 A) (Year: 2020).*
English machine translation of Masaya (JP 2014125682 A) (Year: 2014).*
English machine translation of JP_2012153754_A (Year: 2012).*
Notice of Reasons for Refusal, dated Dec. 9, 2025, which was issued for the corresponding Japanese Patent Application No. 2022-147091, 9 pages, with English translation.

* cited by examiner

*Primary Examiner* — Douglas X Rodriguez
*Assistant Examiner* — Natasha Dephenia Quinn
(74) *Attorney, Agent, or Firm* — LUCAS & MERCANTI, LLP

(57) ABSTRACT

A fabric treatment agent used for printing with a sublimation coloring material, includes: at least an aromatic heterocyclic compound I and an aromatic heterocyclic compound II, wherein a weight average molecular weight of the aromatic heterocyclic compound I is smaller than a weight average molecular weight of the aromatic heterocyclic compound II.

20 Claims, 3 Drawing Sheets

FABRIC TREATMENT AGENT, FABRIC PRINTING METHOD, FABRIC PRINTING APPARATUS, AND PRINTED FABRIC

CROSS-REFERENCE TO RELATED APPLICATIONS

The entire disclosure of Japanese Patent Application No. 2022-147091, filed on Sep. 15, 2022, including description, claims, drawings and abstract is incorporated herein by reference.

BACKGROUND

Technical Field

The present invention relates to a fabric treatment agent, a fabric printing method, a fabric printing apparatus, and a printed fabric. More specifically, the present invention relates to a fabric treatment agent and the like which, when used for textile printing with a sublimation coloring material, improves the washing fastness of a printed fabric.

Description of Related Art

As a method for printing on a fabric, a technique using a sublimation coloring material is known. Since the dyeability of the obtained product is good and the burden on the environment can be reduced, it has been widely used in recent years.

The sublimation coloring material is a dispersible dye and is not dissolved in water by itself, but is dispersed in water by being mixed with a dispersant. The dispersible dye is dyed in such a manner that a dye molecule diffuses from a gap of an amorphous portion of a fiber to the inside of the fiber, and the dye molecule and a fiber molecule are bonded to each other by an intermolecular force or a hydrogen bond.

For example, in polyester, a gap of an amorphous portion is small at room temperature, and a dye molecule hardly enters. When the polyester is heated to a temperature equal to or higher than the glass transition temperature, the micro-Brownian motion is activated to open the gaps in the polymer chains, so that the dye molecules can easily enter the gaps. Thereafter, the gaps in the polymer chains are closed at room temperature, and the dye molecules are confined inside the fibers to perform dyeing.

In addition, since polyester exhibits hydrophobicity, it has high affinity with dye molecules that also exhibit hydrophobicity, and the dye that has entered the gap in the polymer chain is easily fixed.

Therefore, the fabric to be used is generally limited to a chemical fiber which can be dyed with a sublimation coloring material such as polyester. However, since dyeing with a sublimation coloring material can reduce the burden on the environment, application to natural fibers, cellulose regenerated fibers and the like is expected.

Compared to polyester, natural fibers and cellulose regenerated fibers are relatively hydrophilic and therefore have low affinity for hydrophobic dye molecules, making it difficult for the dye to be fixed in the fibers. In particular, the washing fastness of fabric on which printing is performed (printed fabric) has been a significant problem.

Japanese Unexamined Patent Publication No. H07-216763 discloses the following technology. After dyeing a fabric base material by a sublimation transfer method, and then, a synthetic resin liquid dyeable with a dispersible dye is applied to the surface of a fabric base material and heated and dried. Thus, the dye particles dyed on the fabric base material are enclosed and fixed inside the fabric base material. Although the washing fastness of the printed fabric has been improved to some extent by the aforementioned technologies, it cannot be said that it is sufficient.

SUMMARY

The present invention has been made in view of the above-described problems and circumstances, and an object of the present invention is to provide a fabric treatment agent, a fabric printing method, a fabric printing apparatus, and a printed fabric, which are used for printing with a sublimation coloring material to improve the washing fastness of the printed fabric.

The present inventors have studied the causes of the above-mentioned problems in order to solve the above-mentioned problem, and as a result, they have found that in a fabric treatment agent to be used for printing with a sublimation coloring material, the washing fastness of the printed fabric is improved by including at least: (A) two kinds of aromatic heterocyclic compounds, or (B) a coloring material scavenging compound and an ultraviolet absorber, and have reached to the present invention.

That is, the aforementioned problem according to the present invention is solved by the following means.

According to one aspect of an embodiment of the present invention, a fabric treatment agent used for printing with a sublimation coloring material, including: at least an aromatic heterocyclic compound I and an aromatic heterocyclic compound II, wherein a weight average molecular weight of the aromatic heterocyclic compound I is smaller than a weight average molecular weight of the aromatic heterocyclic compound II.

According to another aspect, a fabric treatment agent used for printing with a sublimation coloring material including: at least a coloring material scavenging compound and an ultraviolet absorber.

A fabric printing method to print on a fabric with a sublimation coloring material, the method including: applying an aromatic heterocyclic compound I to the fabric; applying an aromatic heterocyclic compound II to the fabric; and applying the sublimation coloring material to the fabric, wherein a weight average molecular weight of the aromatic heterocyclic compound I is smaller than a weight average molecular weight of the aromatic heterocyclic compound II.

A fabric printing method to print on a fabric with a sublimation coloring material, the method including: applying a coloring material scavenging compound to the fabric; applying an ultraviolet absorber to the fabric; and applying the sublimation coloring material to the fabric.

A fabric printing apparatus to print on a fabric with a sublimation coloring material, the fabric printing apparatus including: a section that applies an aromatic heterocyclic compound I to the fabric; a section that applies an aromatic heterocyclic compound II to the fabric; and a section that applies the sublimation coloring material to the fabric, wherein, a weight average molecular weight of the aromatic heterocyclic compound I is smaller than a weight average molecular weight of the aromatic heterocyclic compound II.

A fabric printing apparatus to print on a fabric with a sublimation coloring material, the fabric printing apparatus including; a section that applies a coloring material scavenging compound to the fabric; a section that applies an ultraviolet absorber to the fabric; and a section that applies the sublimation coloring material to the fabric.

A printed fabric containing a sublimation coloring material, the printed fabric including: an aromatic heterocyclic compound I and an aromatic heterocyclic compound II, wherein a weight average molecular weight of the aromatic heterocyclic compound I is smaller than a weight average molecular weight of the aromatic heterocyclic compound II.

A printed fabric containing a sublimation coloring material, the printed fabric including: a coloring material scavenging compound and an ultraviolet absorber.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION

Figure 1:
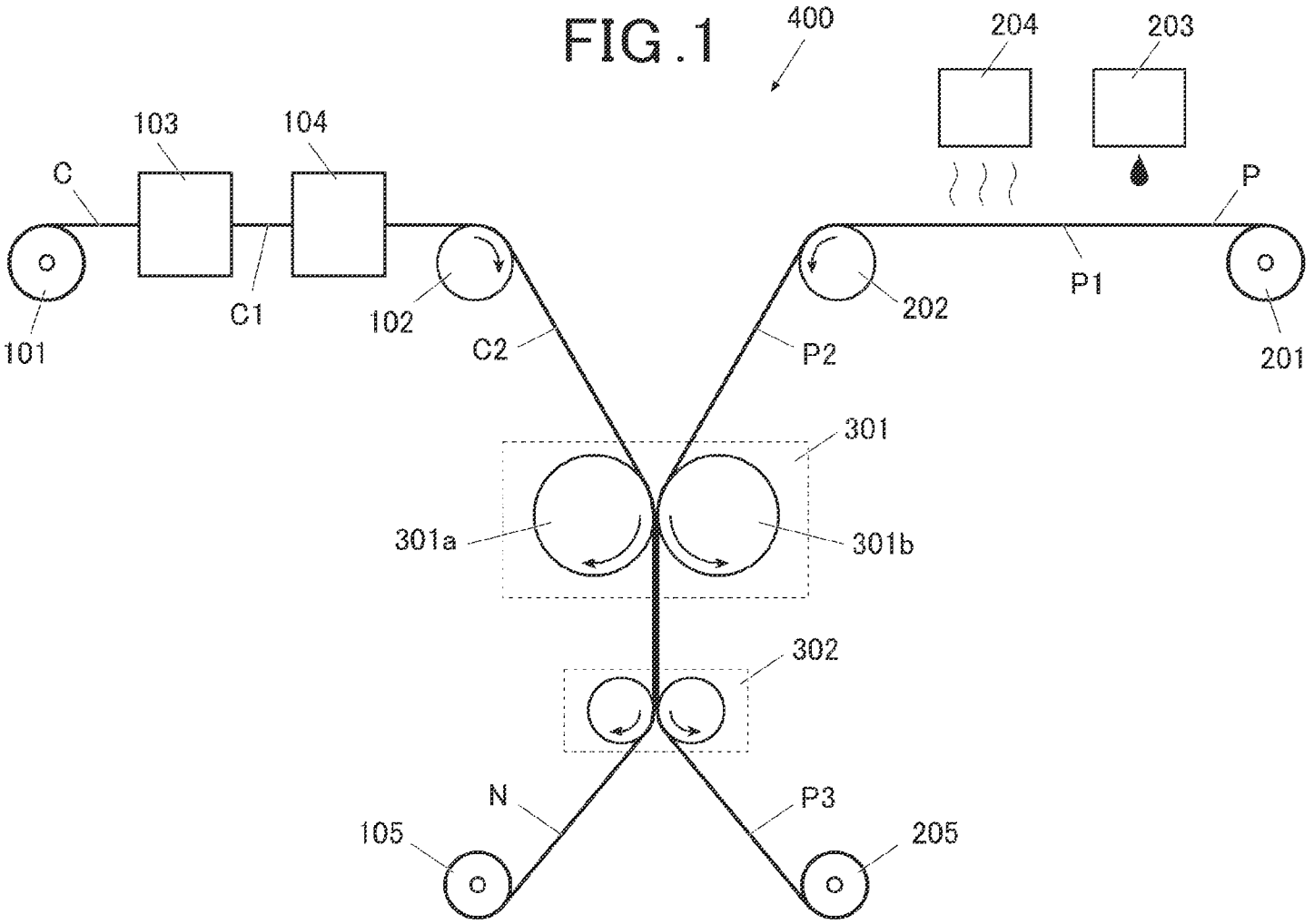
FIG. 1 is a schematic view of a fabric printing apparatus (sublimation transfer method) of the present invention.

The fabric treatment agent of the present invention is a fabric treatment agent for use in printing with a sublimation coloring material, wherein the fabric treatment agent contains at least an aromatic heterocyclic compound I and an aromatic heterocyclic compound II, and the weight average molecular weight of the aromatic heterocyclic compound I is smaller than the weight average molecular weight of the aromatic heterocyclic compound II.

In addition, the fabric treatment agent of the present invention is a fabric treatment agent used for printing with a sublimation coloring material, wherein the fabric treatment agent contains at least a coloring material scavenging compound and an ultraviolet absorber.

These features are technical features common to or corresponding to the following embodiments.

In an embodiment of the present invention, in light of the washing fastness of the printed fabric, the weight average molecular weight of the aromatic heterocyclic compound I is preferably 350 or less.

As an embodiment of the present invention, from the viewpoint of the dyeability and the washing fastness of the printed fabric, it is preferable that the weight average molecular weight of the aromatic heterocyclic compound II is greater than 350.

In an embodiment of the present invention, from the viewpoint of the washing fastness and lightfastness of the printed fabric, the content of the aromatic heterocyclic compound I is preferably within a range of 1.0 to 5.0% by mass based on the total mass of the fabric treatment agent.

In an embodiment of the present invention, from the viewpoint of the dyeability and washing fastness of printed fabric, the content of the aromatic heterocyclic compound II is preferably within a range of 1.0 to 30.0% by mass based on the total mass of the fabric treatment agent.

In an embodiment of the present invention, from the viewpoint of the dyeability and washing fastness of the printed fabric, the aromatic heterocyclic compound I or the aromatic heterocyclic compound II is preferably a compound having a structure containing a pyrazole ring, a triazole ring or an imidazole ring.

In an embodiment of the present invention, from the viewpoint of the washing fastness and lightfastness of printed fabric, the aromatic heterocyclic compound I is preferably a compound having a structure containing a benzotriazole ring.

In an embodiment of the present invention, in light of the washing fastness of the printed fabric, the weight average molecular weight of the ultraviolet absorber is preferably 350 or less.

As an embodiment of the present invention, from the viewpoint of the dyeability and the washing fastness of a printed fabric, it is preferable that the weight average molecular weight of the coloring material scavenging compound is greater than 350.

In an embodiment of the present invention, from the viewpoint of the washing fastness and lightfastness of printed fabric, the content of the ultraviolet absorber is preferably within a range of 1.0 to 5.0% by mass based on the total mass of the fabric treatment agent.

In an embodiment of the present invention, from the viewpoint of the dyeability and washing fastness of the printed fabric, the content of the coloring material scavenging compound is preferably within a range of 1.0 to 30.0% by mass based on the total mass of the fabric treatment agent.

In an embodiment of the present invention, from the viewpoint of the dyeability and washing fastness of printed fabric, the coloring material scavenging compound or the ultraviolet absorber is preferably a compound having a structure containing a pyrazole ring, a triazole ring or an imidazole ring.

In an embodiment of the present invention, in light of the washing fastness and lightfastness of the printed fabric, the ultraviolet absorber is preferably a compound having a structure containing a benzotriazole ring.

In an embodiment of the present invention, it is preferable to further contain an organic solvent from the viewpoint of dyeability and washing fastness of the printed fabric.

According to an embodiment of the present invention, from the viewpoints of the dyeability and the washing fastness of the printed fabric, the value of the ratio (I/O value) of the inorganic value to the organic value of the organic solvent is preferably within a range of 1 to 3.

In an embodiment of the present invention, from the viewpoint of lightfastness of the printed fabric, it is preferable to further contain an antioxidant.

In an embodiment of the present invention, from the viewpoint of the lightfastness of the printed fabric, the content of the antioxidant is preferably within a range of 0.5 to 3.0% by mass based on the total mass of the fabric treatment agent.

The fabric printing method of the present invention is a printing method for printing a fabric with a sublimation coloring material, including the steps of: providing an aromatic heterocyclic compound I to the fabric, providing an aromatic heterocyclic compound II to the fabric, and providing the sublimation coloring material to the fabric. A weight average molecular weight of the aromatic heterocyclic compound I is smaller than a weight average molecular weight of the aromatic heterocyclic compound II.

In addition, the fabric printing method of the present invention is a printing method for printing a fabric with a sublimation coloring material, the printing method including: a step of applying a coloring material scavenging compound to the fabric; a step of applying an ultraviolet absorber to the fabric; and a step of applying the sublimation coloring material to the fabric.

As an embodiment of the present invention, from the viewpoint of dyeability and washing fastness of the printed fabric, it is preferable to include a step of applying the fabric treatment agent of the present invention to the fabric and a step of applying the sublimation coloring material to the fabric.

As an embodiment of the present invention, from the viewpoint of the dyeability of the printed fabric, it is preferable that the fabric contains a cellulose fiber.

In an embodiment of the present invention, in light of dyeability and washing fastness, the method of applying the sublimation coloring material to the fabric is preferably a sublimation transfer method.

The fabric printing apparatus of the present invention is a fabric printing apparatus for printing a fabric with a sublimation coloring material, including means for applying an aromatic heterocyclic compound I to the fabric, means for applying an aromatic heterocyclic compound II to the fabric, and means for applying the sublimation coloring material to the fabric. The weight average molecular weight of the aromatic heterocyclic compound I is smaller than the weight average molecular weight of the aromatic heterocyclic compound II.

Furthermore, a fabric printing apparatus of the present invention is a fabric printing apparatus for printing a fabric with a sublimation coloring material, and includes a means for applying a coloring material scavenging compound to the fabric, a means for applying an ultraviolet absorber to the fabric, and a means for applying the sublimation coloring material to the fabric.

As an embodiment of the present invention, from the viewpoints of the dyeability and the washing fastness of the printed fabric, it is preferable to have means for applying the fabric treatment agent of the embodiment of the present invention to the fabric and means for applying the sublimation coloring material to the fabric.

In an embodiment of the present invention, in light of dyeability and washing fastness, the method of applying the sublimation coloring material to the fabric is preferably a sublimation transfer method.

The printed fabric of the present invention is the printed fabric containing the sublimation coloring material, and contains the aromatic heterocyclic compound I and the aromatic heterocyclic compound II. The weight average molecular weight of the aromatic heterocyclic compound I is smaller than a weight average molecular weight of the aromatic heterocyclic compound II.

In addition, the printed fabric according to an embodiment of the present invention contains the sublimation coloring material, and contains the coloring material scavenging compound and the ultraviolet absorber.

Hereinafter, the present invention, the constituent element thereof, and modes and aspects for carrying out the present invention will be described in detail. In the present application, "to" or "–" is used to mean that the numerical values described before and after it are included as the lower limit value and the upper limit value.

1 Summary of Fabric Treatment Agent

The fabric treatment agent of the present invention has either (A) a composition containing an aromatic heterocyclic compound I and an aromatic heterocyclic compound II, or (B) a composition containing a coloring material scavenging compound and an ultraviolet absorber. Thus, the washing fastness of the printed fabric is improved. Hereinafter, (A) the composition containing the aromatic heterocyclic compound I and the aromatic heterocyclic compound II is also referred to as "composition (A)". Further, (B) the composition containing coloring material scavenging compound and an ultraviolet absorber is referred to as "composition (B)".

The fabric treatment agent of the present invention is a fabric treatment agent for use in printing with a sublimation coloring material. The fabric treatment agent contains at least an aromatic heterocyclic compound I and an aromatic heterocyclic compound II, and the weight average molecular weight of the aromatic heterocyclic compound I is smaller than the weight average molecular weight of the aromatic heterocyclic compound II. Hereinafter, the fabric treatment agent is also referred to simply as "treatment agent".

That is, the treatment agent of the present invention is characterized in that two kinds of aromatic heterocyclic compounds having different weight average molecular weights are used in combination.

By using the treatment agent of the present invention in printing with the sublimation coloring material, the aromatic heterocyclic compound can be contained inside the fiber. Furthermore, by using two kinds of aromatic heterocyclic compounds having different weight average molecular weights in combination, both the dyeability and the washing fastness of the printed fabric can be achieved.

In addition, the fabric treatment agent of the present invention is a fabric treatment agent used for printing with the sublimation coloring material, wherein the fabric treatment agent contains at least the coloring material scavenging compound and the ultraviolet absorber.

In addition, by using the treatment agent of the embodiment of the present invention, the coloring material scavenging compound and the ultraviolet absorber can be incorporated into the inside of the fiber. Thus, the dyeability, the lightfastness, and the washing fastness of the printed fabric can all be achieved.

In the present invention, the term "pretreatment agent" refers to the treatment agent that is applied to the fabric before or at the same time as the application of the ink to the fabric. The "post-treatment agent" refers to the treatment agent that is applied to the fabric after the ink is applied to the fabric.

It is considered that even when the aromatic heterocyclic compound according to the present invention is contained in the post-treatment agent, the washing fastness of the printed fabric to be finally obtained can be improved. In addition, it is considered that the washing fastness of the finally obtained printed fabric can be improved even when the aromatic heterocyclic compound according to the present invention is contained in the ink containing the sublimation coloring material. However, from the viewpoint of significant improvement in washing fastness, the aromatic heterocyclic compound according to the present invention is preferably contained in the pretreatment agent.

Note that in the present invention, "dyeing" refers to fixing the dye on the fabric using the coloring material (dye), and "dyeability" refers to the extent and degree of fixing of the dye. In addition, "color development" refers to the development of a desired color on a fabric using a coloring material (dye), and "color developability" refers to the extent and degree of the color development with respect to the desired color.

2. Composition of Fabric Treatment Agent

The treatment agent of the present invention contains at least (A) an aromatic heterocyclic compound I and an aromatic heterocyclic compound II, that is, two kinds of aromatic heterocyclic compounds having different weight average molecular weights. Alternatively, the treatment agent of the present invention contains at least (B) the coloring material scavenging compound and the ultraviolet absorber.

Both of the compositions (A) and (B) may further contain an organic solvent, an antioxidant, water, and the like, and the organic solvent, the antioxidant, and water can be used in common.

In addition, the number of kinds of aromatic heterocyclic compounds contained in the treatment agent of the embodiment of the present invention may be three or more. At this time, two kinds of aromatic heterocyclic compounds having a large content with respect to the total mass of the treatment agent are defined as an aromatic heterocyclic compound I or an aromatic heterocyclic compound II.

(1) Aromatic Heterocyclic Compound (Composition (A))

In the present invention, the "aromatic heterocyclic compound" refers to a compound having an aromatic ring (aromatic heterocycle) composed of carbon and a heteroatom other than carbon.

Therefore, in a case where an atom constituting an aromatic ring is only carbon and a heteroatom constitutes a substituent substituting for the aromatic ring, such case does not apply to the above-described aromatic heterocyclic compound.

As the heteroatom constituting the aromatic heterocycle, an oxygen atom, a nitrogen atom or a sulfur atom is preferable. Among these, from the viewpoint of capturing dye molecules, a nitrogen atom is preferable.

The aromatic heterocycle may be a monocyclic ring or a condensed ring.

Examples of the aromatic heterocycle include a pyrazole ring, a triazole ring, an imidazole ring, a triazine ring, a pyridine ring, an allidine ring, an indole ring, a quinoline ring, a pyrrole ring and a thiophene ring. Among these, from the viewpoint of trapping dye molecules, a pyrazole ring, a triazole ring, or an imidazole ring is preferable.

Furthermore, the aromatic heterocycle may further have a substituent. Examples of the substituent include an alkyl group, an alkenyl group, a hydroxy group, an alkoxy group, an alkyl ester group, an alkyl ether group, a carboxy group, an acyl group, an amino group, an imino group, a cyano group, a nitro group, and a halogen atom.

In particular, when the fabric contains natural fiber or a cellulose regenerated fiber that exhibits relatively hydrophilicity, the aromatic heterocycle preferably has a hydrophilic substituent. In a case where the aromatic heterocycle has a hydrophilic substituent, the aromatic heterocyclic compound is easily disposed inside the fiber.

The aromatic heterocyclic compound preferably has three or more aromatic rings, and more preferably has five or more aromatic rings. In addition, it is preferable to have a structure in which two aromatic rings are bonded by a single bond as a part or the whole. By adopting such a composition, the aromaticity of the compound as a whole is enhanced, and the π-π interaction with the dye molecule is strengthened. As a result, the ability to trap dye molecules is improved, and the dyeability is improved.

Examples of the aromatic ring include, in addition to the aforementioned aromatic heterocycles, a benzene ring, a naphthalene ring, a pentalene ring, an indene ring, an azulene ring, a heptalene ring, an indacene ring, a perylene ring, a pentacene ring, a quatenylene ring, an acenaphthene ring, a phenanthrene ring, an anthracene ring, a naphthacene ring, a chrysene ring, a triphenylene ring and a fluorene ring.

These may further have the same substituent as the substituent in the aromatic heterocycle.

The aromatic heterocyclic compound according to the present invention will be exemplified. Note that the aromatic heterocyclic compound according to the present invention is not limited to these.

[Chemical Formula 1]

COMPOUND (1)

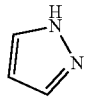

COMPOUND (2)

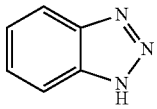

COMPOUND (3)

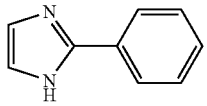

COMPOUND (4)

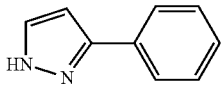

COMPOUND (5)

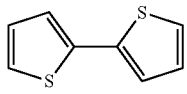

COMPOUND (6)

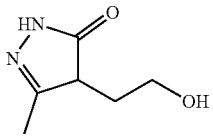

COMPOUND (7)

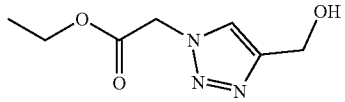

COMPOUND (8)

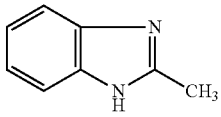

-continued
COMPOUND (9)
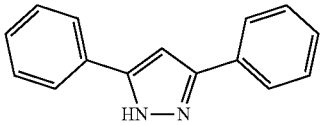
COMPOUND (10)
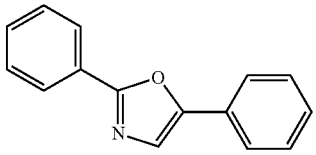
COMPOUND (11)
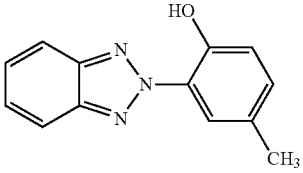
COMPOUND (12)
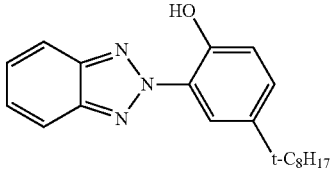
COMPOUND (13)
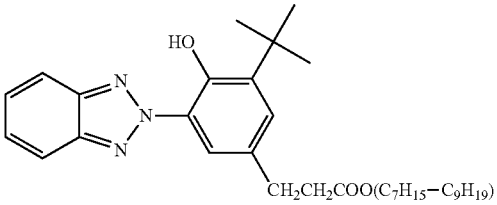
COMPOUND (14)
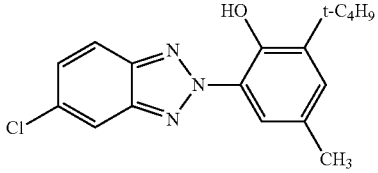
[Chemical Formula 2]
COMPOUND (15)
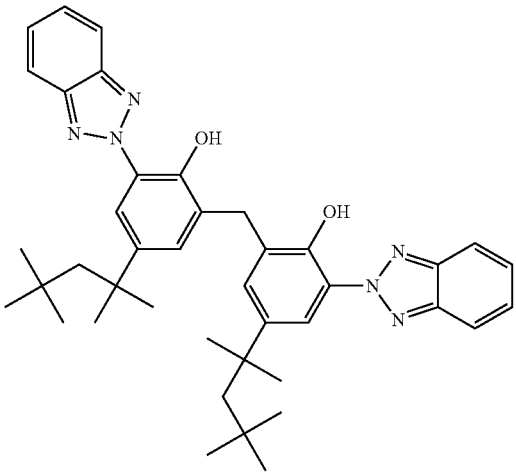
COMPOUND (16)
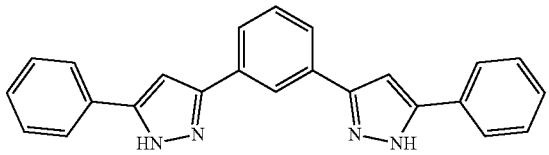
COMPOUND (17)
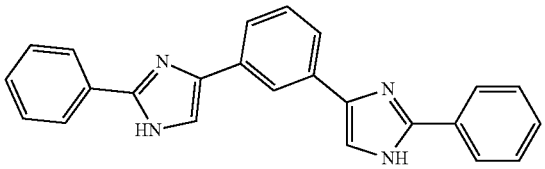
COMPOUND (18)
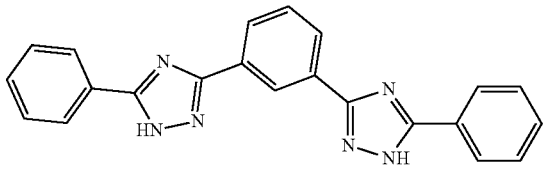

-continued
COMPOUND (19)
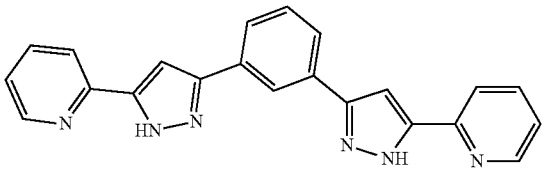
COMPOUND (20)
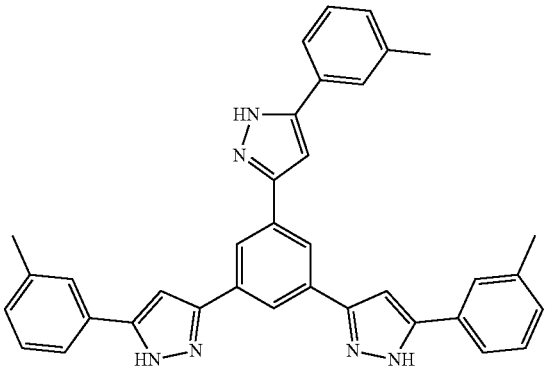
COMPOUND (21)
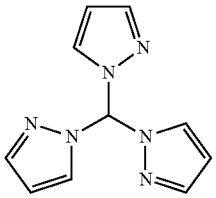
[Chemical Formula 3]
COMPOUND (22)
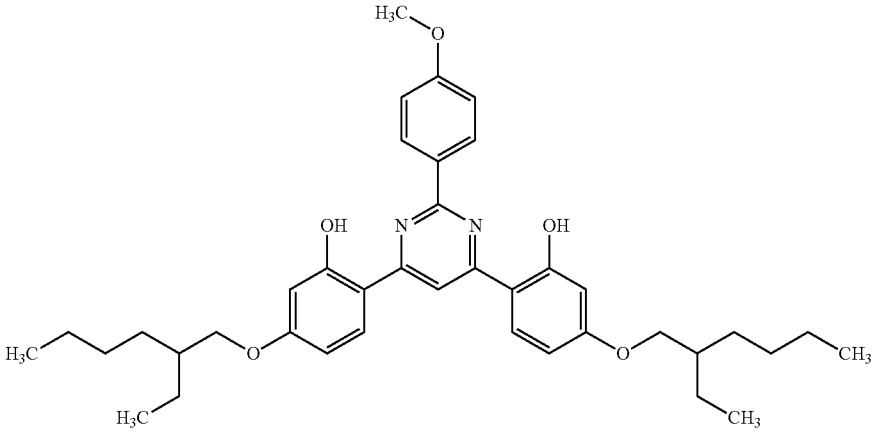
COMPOUND (23)
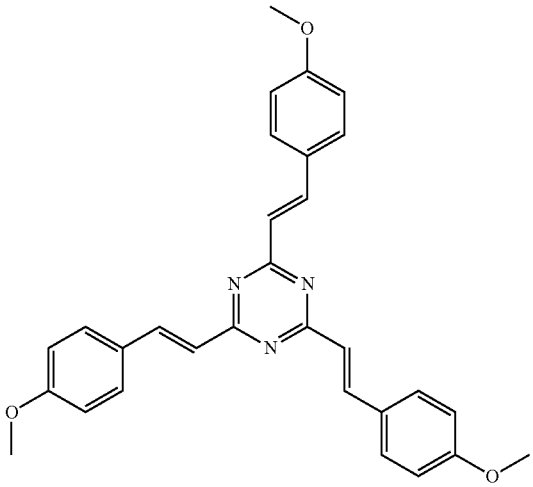
COMPOUND (24)
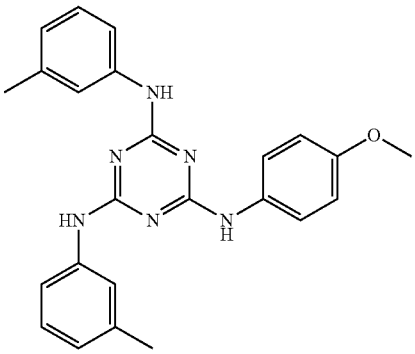

-continued

COMPOUND (25)

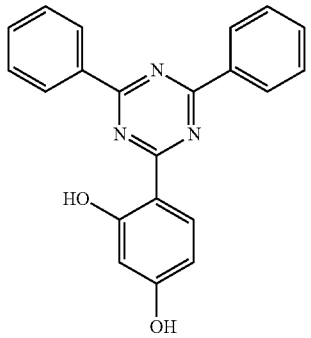

In the present invention, one of the two types of aromatic heterocyclic compounds which has a smaller weight average molecular weight (Mw) is referred to as an aromatic heterocyclic compound I, and the other which has a larger weight average molecular weight (Mw) is referred to as an aromatic heterocyclic compound II.

The "weight average molecular weight (Mw)" refers to a weight average molecular weight obtained from a retention time of a maximum peak in a case where analysis is performed using gel permeation chromatography (GPC) by the following method. Note that the retention time measured by GPC is converted with reference to the retention time of standard polystyrene.

(Method For Measuring Weight Average Molecular Weight)

The weight average molecular weight of the aromatic heterocyclic compound can be measured by the following method using gel permeation chromatography (GPC).

N-methyl-2-pyrrolidone (NMP) 10.0 g was added to and dissolved in an aromatic heterocyclic compound sample 0.03 g to obtain a sample liquid. Measurement is performed using the obtained sample liquid under the following conditions.

Apparatus: Alliance e2695 (manufactured by Waters Corporation)

Column: Waters PAH C18 Column (manufactured by Waters Corporation)

Measurement Wavelength: 260 nm

Mobile Phase: Mixed solution of N-methyl-2-pyrrolidone (NMP), lithium chloride (LiCl)) and phosphoric acid in the following mass ratio (NMP/LiCl/Phosphoric acid=980.0/2.1/4.8 (parts by mass))

Flow Rate: 0.4 mL/min

Column Temperature: 50° C.

The weight average molecular weight of the aromatic heterocyclic compound is not particularly limited. Provided that in light of washing fastness, the weight average molecular weight of the aromatic heterocyclic compound I is preferably 350 or less. The weight average molecular weight of the aromatic heterocyclic compound II is preferably more than 350.

From the viewpoint of trapping dye molecules, the total content of the two kinds of aromatic heterocyclic compounds is preferably within a range of 2.0 to 31.0% by mass, and more preferably within a range of 10.0 to 20.0% by mass, based on the total mass of the treatment agent.

In particular, the content of the aromatic heterocyclic compound I is preferably in a range of 1.0 to 5.0% by mass and more preferably in a range of 2.0 to 3.0% by mass with respect to the total mass of the treatment agent.

The content of the aromatic heterocyclic compound II is preferably within a range of 1.0 to 30.0% by mass, more preferably within a range of 10.0 to 20.0% by mass, relative to the total mass of the treatment agent.

(2) Coloring Material Scavenging Compound and Ultraviolet Absorber (Composition (B))

(2.1) Coloring Material Scavenging Compound

In the present invention, the "coloring material scavenging compound" refers to a compound having a function of capturing a coloring material (sublimation coloring material). Specifically, it refers to a compound having an Rf value of 0.7 or less obtained by the following paper chromatography method.

[Conditions of Paper Chromatography Method]

Procedure 1: A cellulose filter paper is impregnated with a solution including 10% by mass of a coloring material scavenging compound and then dried to prepare a carrier.

Procedure 2: A tetrahydrofuran solution including 0.1% by mass of sublimation coloring material is spotted on a carrier and then dried to prepare a development sample.

Procedure 3: The development sample is developed with acetonitrile at 25° C. for 3 minutes.

Procedure 4: An Rf value is obtained from the following expression.

*Rf* value=development distance of sublimation coloring material/development distance of acetonitrile (Expression)

Hereinafter, the details of each procedure will be described.

(Procedure 1)

A 5C type cellulose filter paper defined in JIS P 3801: 1995 is impregnated with the solution including 10% by mass of the coloring material scavenging compound and then dried to prepare a carrier. The solvent used for the solution including 10% by mass of the coloring material scavenging compound is not particularly limited as long as the solvent can dissolve the coloring material scavenging compound. As the solvent, a solvent that can be contained in the fabric treatment agent can be used. The shape of the cellulose filter paper is not particularly limited, and may be, for example, a strip shape. The size of the cellulose filter paper is not particularly limited, but needs to be a size that allows sufficient development in Procedure 3. The impregnation of the solution to the cellulose filter paper is performed by immersing the cellulose filter paper in the solution for 1 minute. The drying conditions are not particularly limited as long as the carrier can be sufficiently dried to such an extent that the mass of the carrier is stabilized under an environment of 25° C. and 50% RH.

(Procedure 2)

The solution including 0.1% by mass of tetrahydrofuran which is the sublimation coloring material (sublimation coloring material used for printing together with the coloring material scavenging compound) is spotted on the carrier and then dried to prepare the development sample. Spotting of the solution can be performed using a capillary. The volume of the solution to be spotted is preferably within a range of 0.5 to 2 μL, more preferably 1 μL. The position of the spot is a position 1 cm from the lower end of the cellulose filter paper. The drying conditions are not particularly limited as long as the development sample can be sufficiently dried to such an extent that the mass of the development sample is stabilized under the environment of 25° C. and 50% RH.

(Procedure 3)

The development sample is developed with acetonitrile at 25° C. for 3 minutes. Specifically, the development sample is placed standing in a developing tank containing acetonitrile so that the portion spotted in Procedure 2 is not immersed in acetonitrile. The developing tank is covered and the development sample is developed. The development time is 3 minutes after the cellulose filter paper is immersed in acetonitrile.

(Procedure 4)

The Rf value is determined from the following expression.

*Rf* value=development distance of sublimation coloring material/development distance of acetonitrile (Expression)

The "development distance of the sublimation coloring material" is a distance from the center of the portion spotted in the procedure 2 to a position where the color is darkest in the spot after development. In a case where it is difficult to discriminate the position with the darkest color, the distance is the distance from the center of the portion spotted in the procedure 2 to the center of the leading end and the rear end of the spot.

The "development distance of acetonitrile" is a distance from the center of the portion spotted in procedure 2 to the tip of the acetonitrile after development.

The Rf value may be an average value obtained by performing measurement a plurality of times in consideration of measurement accuracy.

The Rf value is preferably 0.5 or less, more preferably 0.3 or less, and still more preferably 0.2 or less, from the viewpoint of the ability to trap the coloring material.

The coloring material scavenging compound according to the present invention is not particularly limited as long as it is a compound having an Rf value of 0.7 or less. Provided that, from the viewpoint of the ability to trap the coloring material, a compound having an aromatic ring is preferable, a compound having an aromatic heterocycle is more preferable, and the aforementioned aromatic heterocyclic compound is preferable.

The weight average molecular weight of the coloring material scavenging compound is not particularly limited, but is preferably greater than 350 from the viewpoint of washing fastness.

The content of the coloring material scavenging compound is preferably in a range of 1.0 to 30.0% by mass and more preferably in a range of 10.0 to 20.0% by mass with respect to the total mass of the treatment agent.

(2.2) Ultraviolet Absorber

In the present invention, the term "ultraviolet absorber" refers to a compound having a function of absorbing ultraviolet rays and converting the ultraviolet rays into energy such as heat.

The ultraviolet absorber is not particularly limited, and examples thereof include benzotriazole-based, triazine-based, benzophenone-based, benzoate-based, benzoimidazole-based, and cyanoacrylate based ultraviolet absorbers.

Among these, a benzotriazole-based ultraviolet absorber is preferable from the viewpoint of having heat resistance and being able to be used in printing using a sublimation coloring material. In particular, from the viewpoint of capturing a coloring material, a benzotriazole-based ultraviolet absorber which is an aromatic heterocyclic compound is preferable.

The ultraviolet absorber according to the present invention is exemplified. Note that the ultraviolet absorber according to the present invention is not limited to these.

[Chemical Formula 4]

COMPOUND (101)

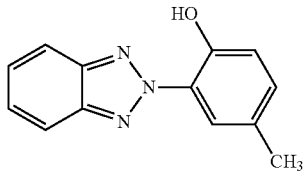

COMPOUND (102)

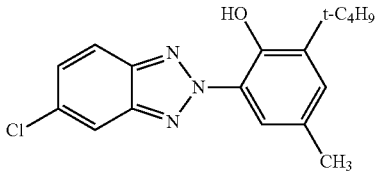

COMPOUND (103)

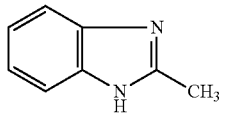

COMPOUND (104)

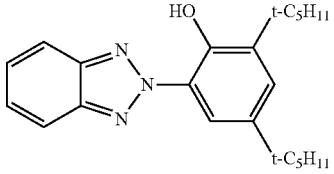

-continued
COMPOUND (105)
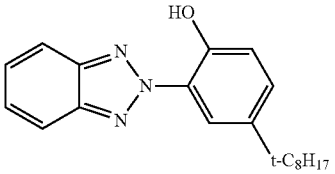
COMPOUND (106)
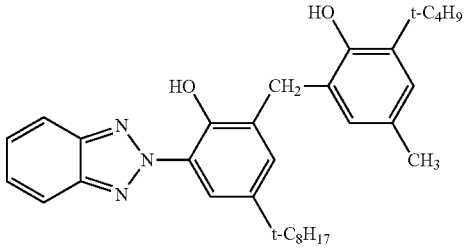
COMPOUND (107)
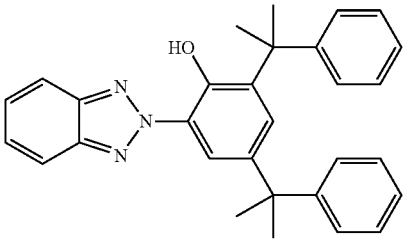
COMPOUND (108)
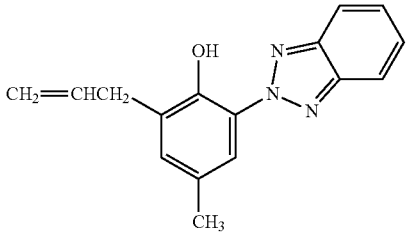
COMPOUND (109)
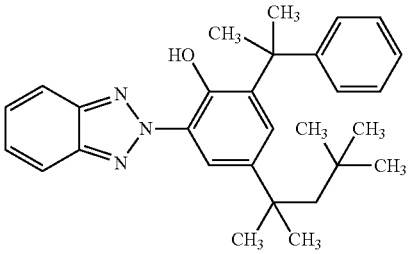
COMPOUND (110)
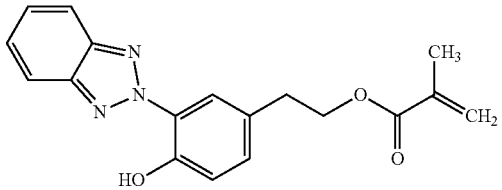
[Chemical Formula 5]
COMPOUND (111)
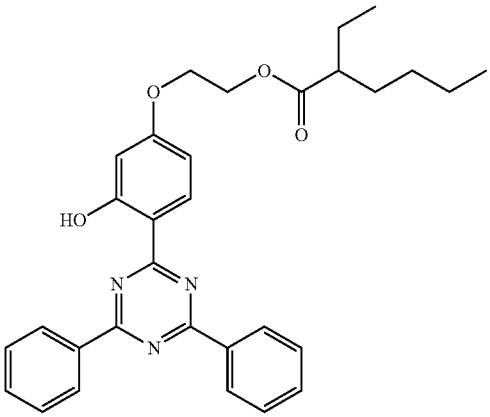

-continued
COMPOUND (112)
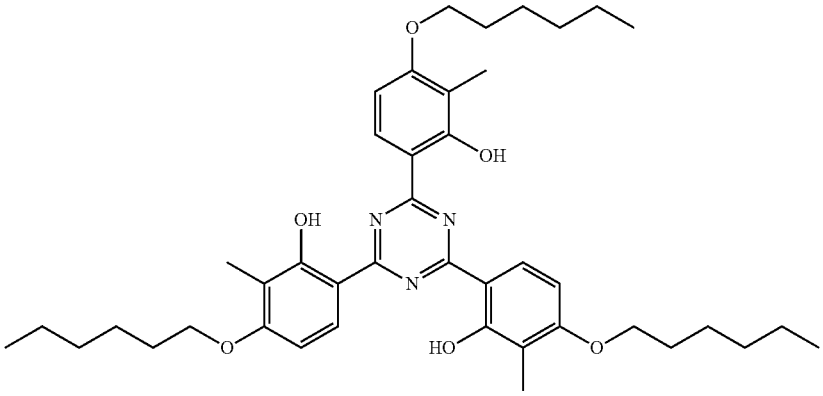
COMPOUND (113)
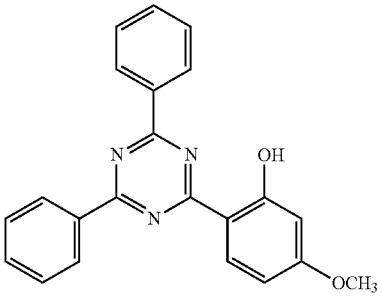
COMPOUND (114)
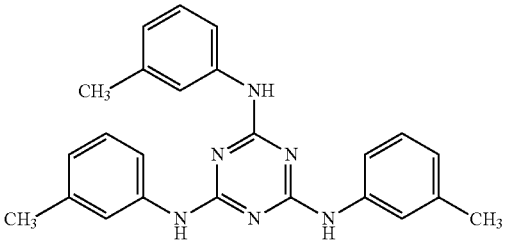
COMPOUND (115)
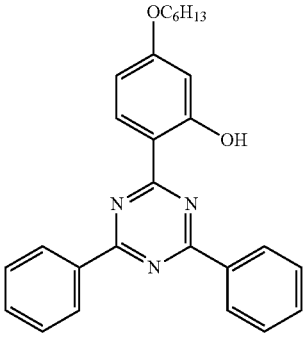
COMPOUND (116)
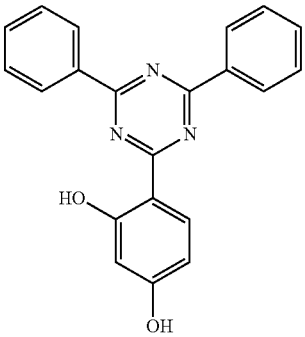
[Chemical Formula 6]
COMPOUND (117)
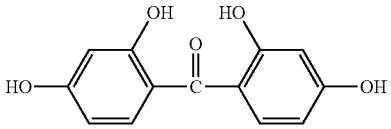
COMPOUND (118)
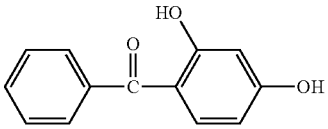
COMPOUND (119)
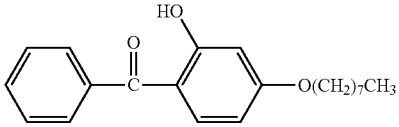
COMPOUND (120)
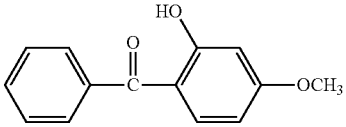
COMPOUND (121)
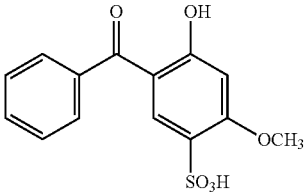
COMPOUND (122)
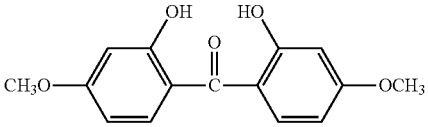

-continued

COMPOUND (123)

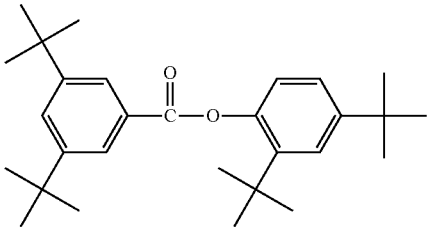

COMPOUND (124)

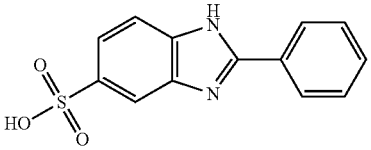

COMPOUND (125)

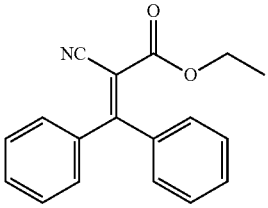

COMPOUND (126)

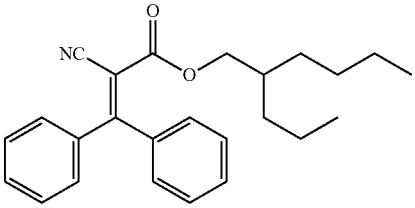

COMPOUND (127)

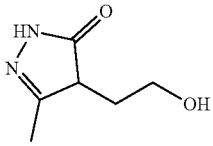

COMPOUND (128)

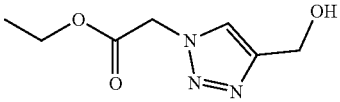

The ultraviolet absorber according to the present invention is not particularly limited. However, a compound having an aromatic ring is preferable from the viewpoint of washing fastness, that is, from the viewpoint of the ability to capture the coloring material. The ultraviolet absorber is more preferably a compound having an aromatic heterocycle, and is preferably the aforementioned aromatic heterocyclic compound.

The weight average molecular weight of the ultraviolet absorber is not particularly limited, but is preferably 350 or less from the viewpoint of washing fastness.

The content of the ultraviolet absorber is preferably in a range of 1.0 to 5.0% by mass and more preferably in a range of 2.0 to 3.0% by mass with respect to the total mass of the treatment agent.

Hereinafter, the aromatic heterocyclic compound, the coloring material scavenging compound, and the ultraviolet absorber are also collectively referred to as "aromatic heterocyclic compound or the like".

(3) Organic Solvent

The treatment agent of the present invention preferably further contains an organic solvent.

The organic solvent according to the present invention preferably has a property of swelling the fibers of the fabric (swelling property) and dissolving the dye (dye solubility). By containing such an organic solvent, the sublimation coloring material or the aromatic heterocyclic compound or the like can be carried further inside of the fiber. As a result, natural fibers, cellulose regenerated fibers, and the like, which are usually difficult to print with the sublimation coloring material, can also be printed, and further, the dyeability and the washing fastness are improved.

The organic solvent is not particularly limited, but the value of the ratio between the inorganic value and the organic value (I/O value) is preferably in the range of 1 to 3. When the amount is within the above range, the organic solvent suitably has hydrophilic moieties and hydrophobic moieties. Therefore, an interaction occurs between the organic solvent and the fibers that relatively exhibit hydrophilicity and between the organic solvent and the sublimation coloring material that exhibits hydrophobicity. As a result, it is considered that the fibers of the fabric can be swollen, and the sublimation coloring material or the aromatic heterocyclic compound or the like can be carried into the fibers.

(3.1) I/O Value

The "I/O value" is a value of a ratio (inorganic value/organic value) of an inorganic value (I) to an organic value (O), and is also referred to as an "IOB value" (Inorganic Organic Balance: IOB). The "I/O value" is one of indices indicating the magnitude of the polarity of a compound.

The I/O value is described in detail in the following literature. Examples of the literature include Organic Conceptual Diagram (Yoshio KODA, Sankyo Shuppan Co., Ltd. (1984)); KUMAMOTO PHARMACEUTICAL BULLETIN, Vol. 1, Items 1 to 16 (1954); and Fields of Chemistry, Vol. 11, No. 10, pages 719 to 725 (1957).

The I/O value is a value obtained by treating the polarity of a compound in an organic concept, and this method is one of functional group contribution methods in which a parameter is set for each functional group. An inorganic value and an organic value are indicated for each functional group.

The I/O value is shown by roughly classifying the properties of a compound into an organic group showing a covalent bonding property and an inorganic group showing an ionic bonding property, and showing the properties at respective points on orthogonal coordinates called an organic axis and an inorganic axis.

In the present invention, the term "inorganic value (I)" refers to the magnitude of the effect that various substituents, bonds, and the like of an organic compound have on the boiling point being quantified using the hydroxy group as a reference. Specifically, it refers to a value obtained by defining the influence of one hydroxy group as a numerical value of 100 and quantifying, based on this numerical value, the influences of various substituents, bonds and the like on the boiling point.

When the distance between the boiling point curve of the straight-chain alcohol and the boiling point curve of the straight-chain paraffin is taken in the vicinity of carbon number 5, the distance is about 100° C. Therefore, the influence of one hydroxy group is defined as 100 in numerical value.

For example, the inorganic value (I) of a carboxy group (—COOH) is 150, and the inorganic value (I) of a double bond is 2.

The inorganic value (I) of a certain organic compound is represented by the sum of the inorganic values (I) of various substituents or bonds contained in the organic compound.

The "organic value (O)" refers to the magnitude of the effect that various substituents, bonds, and the like contained in an organic compound have on the boiling point being quantified based on the methylene group in the molecule of the organic compound. Specifically, it refers to a value obtained by defining the influence of one carbon atom as 20 as a numerical value and quantifying, based on this numerical value, the influences of various substituents, bonds and the like on the boiling point.

Since the average value of the increase in boiling point due to the addition of one carbon in the vicinity of carbon number 5 to 10 in the linear saturated hydrocarbon compound is 20° C., the influence of one carbon atom is set to 20 as a numerical value.

For example, the organic value (O) of a nitro group ($—NO_2$) is 70.

Generally, an I/O value closer to 0 indicates a non-polar (hydrophobic, highly organic) organic substance. On the other hand, a larger I/O value indicates a more polar (more hydrophilic and more inorganic) organic material.

Examples of organic solvents include ethylene glycol monoethylene ether (I/O value: 1.5), dimethyl sulfoxide (I/O value: 1.75), butyric acid (I/O value: 1.875), polyethylene glycol (I/O value: 2.0), isobutyric acid (I/O value: 2.143), 2,3-butanediol (I/O value: 2.5), trimethylolethane (I/O value: 3.0), propylene glycol (I/O value: 3.3), polypropylene glycol (I/O value: 3.3), ethylene glycol (I/O value: 5.0), and the like.

In light of the swelling property of the fiber and the dyeability of the printed fabric, the I/O value is preferably within a range of 1 to 3. Among these, the organic solvent preferably contains any one or more of dimethyl sulfoxide, ethylene glycol, and propylene glycol.

Furthermore, the boiling point of the organic solvent is preferably within a range of 150 to 250° C.

Examples of the organic solvents having a boiling point within a range of 150 to 250° C. include propylene glycol (188° C.), ethylene glycol (197° C.), dimethyl sulfoxide (189° C.), and 2,3-butanediol (177° C.).

In light of the dyeability of the printed fabric, the content of the organic solvent is preferably within a range of 5 to 95% by mass, and more preferably within a range of 15 to 50% by mass relative to the total mass of the treatment agent.

(4) Antioxidant

The treatment agent of the embodiment of the present invention preferably further contains an antioxidant.

By containing the antioxidant, the lightfastness of the printed fabric can be improved.

The antioxidant is not particularly limited, and examples thereof include a phenol-based antioxidant, an amine-based antioxidant, a phosphorus-based antioxidant, and a sulfur-based antioxidant. Among these, a phenol-based antioxidant is preferable, and a hindered phenol-based antioxidant is more preferable, from the viewpoint of preventing oxidation by capturing radicals to stop a chain reaction.

Examples of the hindered phenol-based antioxidants include 2, 4,6-tris (3',5'-di-t-butyl-4'-hydroxybenzyl) mesitylene, 2,4-bis-(n-octylthio)-6-(4-hydroxy-3,5-di-t-butylanilino)-1,3,5-triazine, pentaerythritol tetrakis [3-(3,5-di-t-butyl-4-hydroxyphenyl) propionate], octadecyl-3-(3,5-di-t-butyl-4-hydroxyphenyl) propionate, 2,6-di-t-butyl-4-nonylphenol, thiodiethylene bis [3-(3,5-di-t-butyl-4-hydroxyphenyl) propionate], N,N-hexamethylene bis (3,5-di-t-butyl-4-hydroxy-hydrocinnamamide), 3,9-bis [2-[3-(3-t-butyl-4-hydroxy-5-methylphenyl) propionyloxy]-1,1-dimethylethyl]-2-,-4-,-8-,-10-tetraoxaspiro [5.5] undecane, 2,4-di-t-butylphenol, 1,1,3-tris-(2'-methyl-4'-hydroxy-5'-t-butylphenyl)-butane, 1, 3,5-tris (3,5-di-t-butyl-4-hydroxyben) and the like.

Among these, pentaerythritol tetrakis [3-(3,5-di-t-butyl-4-hydroxyphenyl) propionate] is preferable.

Examples of commercially available products of the hindered phenol-based antioxidants include "ADK STAB AO-30, 50, 60, 80, 330" (all of the above, ADEKA Corporation); "IRGANOX565, 1010, 1035, 1076, 1098, 3114" (all of the above manufactured by BASF Japan Ltd.) and "SUMILIZER GA-80" (manufactured by Sumitomo Chemical Co., Ltd).

The content of the antioxidant is preferably within a range of 0.5 to 3.0% by mass and more preferably within a range of 1.0 to 2.0% by mass with respect to the total mass of the treatment agent from the viewpoint of lightfastness.

(5) Water

The treatment agent of the present invention may further contain water.

The water is not particularly limited, and examples thereof include ion-exchanged water, distilled water, and pure water.

The content of water is preferably in a range of 0 to 95% by mass, and more preferably in a range of 0 to 50% by mass with respect to the total mass of the treatment agent.

(6) Other Components

The treatment agent of the present invention may further contain other components than those described above, as necessary. Examples of other components include a surfactant, a preservative, a pH adjuster, and the like.

The surfactant is not particularly limited. However, in a case where an anionic compound is contained in the constituent components of the ink, the ionic property of the surfactant is preferably anionic or nonionic. In a case where the ionicity of the surfactant is amphoteric, the surfactant is preferably a betaine type.

Specific examples thereof include a fluorine-based or silicone-based surfactant having a high static surface tension reducing ability and dioctyl sulfosuccinate having a high dynamic surface tension reducing ability. Also included are anionic surfactants such as sodium dodecyl sulfate. In addition, nonionic surfactants such as polyoxyethylene alkyl ether having a relatively low molecular weight, polyoxyethylene alkyl phenyl ether, acetylene glycols, a Pluronic type surfactant (Pluronic is a registered trademark), and a sorbitan derivative are exemplified.

A fluorine-based or silicone-based surfactant having a high static surface tension reducing ability and a surfactant having a high dynamic surface tension reducing ability may be used in combination.

Examples of the preservative include aromatic halogen compounds, methylene dithiocyanate, halogen-containing nitrogen-sulfur compounds, and 1,2-benzisothiazolin-3-one. Examples of the aromatic halogen compound include "PREVENTOL (Registered trademark) CMK" (manufactured by LANXESS Corporation). Examples of the 1,2-benzisothiazolin-3-one include "PROXELGXL" (manufactured by Lonza Ltd).

Examples of the pH adjuster include citric acid, sodium citrate, hydrochloric acid, and sodium hydroxide.

3. Physical Properties of Fabric Treatment Agent

The viscosity of the treatment agent of the present invention at 25° C. is preferably appropriately adjusted according to the method of applying the treatment agent to fabric. For example, when the treatment agent is applied to the fabric by the inkjet method, the viscosity of the treatment agent is preferably within a range of 4 to 20 mPa·s.

Note that the viscosity of the treatment agent can be measured using an E type viscometer under a condition of 25° C.

4. Fabric

The fabric according to the present invention is not particularly limited. From the perspective of achieving the effects of the present invention, it is preferable to include a fiber that, when pre-treated or post-treated, enables formation of an image by sublimation transfer or improves the quality of the obtained image.

Examples of fibers include natural fibers such as cotton, hemp, wool, silk, and the like, and chemical fibers such as Vinylon, nylon, acryl, polyurethane, acetate, and the like.

In addition, as a type included in the chemical fiber, there is a regenerated fiber (rayon or the like) which is produced by once dissolving the natural fiber such as wood or cotton containing cellulose by a chemical reaction and spinning the fiber again.

Note that in general, an image can be formed using a sublimation coloring material on polyester without performing pretreatment or post-treatment on the polyester. However, when polyester having relatively high hydrophilicity is subjected to pretreatment or post-treatment, the quality of the image to be obtained may be improved (dyeability may be improved) in some cases. In this case, the present invention can be applied.

From the viewpoint of exhibiting the effects of the present invention, the fabric preferably contains natural fibers. In addition, each fabric may be constituted of only one kind of natural fiber or two or more kinds of natural fibers. In addition, in a case where the fabric includes natural fibers, the fabric may be composed of only natural fibers or may be composed of natural fibers and chemical fibers. Here, the chemical fiber may be composed of only one kind or may be composed of two or more kinds.

From the viewpoint of exhibiting the effects of the present invention, it is preferable that the fabric contains cellulose. Cellulose may be contained as the natural fiber or as the above-described regenerated fiber. In addition, each fabric may be constituted of only one kind of fibers containing cellulose or may be constituted of two or more kinds In addition, in a case where the fabric includes a fiber including cellulose and another fiber, the other fiber is preferably polyester.

The fabric may be any form of these fibers such as a woven fabric, a nonwoven fabric, or a knit fabric. Furthermore, the fabric may be a blended woven fabric or a blended nonwoven fabric of two or more kinds of fibers.

The natural fiber ratio and the chemical fiber ratio in the fibers constituting the fabric are expressed as % by mass of the natural fibers and % by mass of the chemical fibers contained relative to the total mass of the fabric. Here, the "total mass of the fabric" refers to the total amount of natural fibers and chemical fibers.

In a case where the fabric includes natural fibers and optionally chemical fibers, a ratio of the natural fibers in the fabric is preferably within a range of 5 to 100% by mass. The ratio of the chemical fibers in the fabric is preferably within a range of 0 to 95% by mass.

In addition, in a case where the fabric includes the fiber including cellulose and polyester, the ratio of the fiber including cellulose is preferably in a range of 35 to 100% by mass with respect to a total mass of the fabric. The ratio of the polyester is preferably within a range of 0 to 65% by mass.

5. Sublimation Ink

The sublimation coloring material according to the present invention is preferably applied to a fabric as a sublimation ink for printing.

Note that the sublimation ink preferably contains a sublimation coloring material, an organic solvent, and water.

(1) Sublimation Coloring Material

In the present invention, the term "sublimation coloring material" refers to a coloring material having a property of sublimating by heating. Among these, a dispersible dye in which a dye that is insoluble or poorly soluble in water is atomized and dispersed in water is preferable.

Here, the phrase "insoluble or poorly soluble in water" means that the solubility in water at 25° C. is 10 mg/L or less. The sublimation coloring material used in the present invention preferably has a water-solubility of 5 mg/L or less, more preferably 1 mg/L or less at 25° C.

The chemical structure of the sublimation coloring material is not particularly limited, but preferably has a large number of aromatic rings. When the sublimation coloring material has a large number of aromatic rings, π-π interaction strongly acts between the sublimation coloring material and the aromatic heterocyclic compound or the like, and the sublimation coloring material is more easily fixed to the fabric.

Among the sublimation coloring materials, examples of the dispersible dye include the following dyes.

C.I. Disperse Yellow 3, 4, 5, 7, 9, 13, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 114, 116, 118, 119, 122, 124, 126, 135, 140, 141, 149, 160, 162, 163, 164, 165, 179, 180, 182, 183, 186, 192, 198, 199, 202, 204, 210, 211, 215, 216, 218, 224, etc.

C.I. Disperse Orange 1, 3, 5, 7, 11, 13, 17, 20, 21, 25, 29, 30, 31, 32, 33, 37, 38, 42, 43, 44, 45, 47, 48, 49, 50, 53, 54, 55, 56, 57, 58, 59, 61, 66, 71, 73, 76, 78, 80, 89, 90, 91, 93, 96, 97, 119, 127, 130, 139, 142, etc.

C. I. Disperse Red 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 289, 298, 302, 303, 310, 311, 312, 320, 324, 328, etc.

C.I. Disperse Violet 1, 4, 8, 23, 26, 27, 28, 31, 33, 35, 36, 38, 40, 43, 46, 48, 50, 51, 52, 56, 57, 59, 61, 63, 69, 77, etc.

C.I. Disperse Green 9, etc.

C.I. Disperse Brown 1, 2, 4, 9, 13, 19, etc.

C.I. Disperse Blue 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333, 359, 360, etc.

C.I. Disperse Black 1, 3, 10, 24, etc.

Among the above, it is preferable to use C.I. Disperse Yellow 54, C.I. Disperse Orange 25, C.I. Disperse Red 60, C.I. Disperse Blue 14, 359, and 360.

The molecular weight of the sublimation coloring material is not particularly limited, but from the viewpoint of making the sublimation coloring material easy to sublimate, the molecular weight is preferably small, and is preferably in a range of 200 to 350. On the other hand, from the viewpoint that the sublimation coloring material having entered the inside of the fibers of the fabric does not easily come off, the molecular weight is preferably suitably large, and is preferably within a range of 350 to 500.

The sublimation coloring material contained in the sublimation ink may be crystallized or may not be crystallized.

The average particle size of the sublimation coloring material in the sublimation ink is not particularly limited, but is preferably 300 nm or less from the viewpoint of ejection stability in an inkjet method. The average particle size can be measured with a commercially available particle size measuring instrument using a light scattering method, an electrophoresis method, a laser Doppler method or the like. In addition, examples of the particle diameter measuring device include "Zetasizer (registered trademark) 1000" (manufactured by Malvern Panalytical).

The content of the sublimation coloring material is not particularly limited, but is preferably in a range of 2 to 10% by mass with respect to the total mass of the sublimation ink. When the content of the sublimation coloring material is 2% by mass or more, high-density textile printing is easily performed. Further, in a case where the content is 10% by mass or less, the viscosity of the sublimation ink does not excessively increase, and a decrease in jetting stability can be suppressed. The content of the sublimation coloring material is more preferably within a range of 5 to 10% by mass with respect to the total mass of the sublimation ink from the same viewpoint.

(2) Water

The sublimation ink according to the present invention may further contain water.

The water is not particularly limited, and examples thereof include ion-exchanged water, distilled water, and pure water.

The content of water is preferably in the range of 40 to 98% by mass, and more preferably in the range of 50 to 70% by mass, with respect to the total mass of the sublimation ink.

(3) Organic Solvents

The sublimation ink according to the present invention may further contain an organic solvent. Among these, a water-soluble organic solvent is preferable.

The total content of water and the water-soluble organic solvent is preferably in the range of 90 to 98% by mass, and more preferably in the range of 90 to 95% by mass with respect to the total mass of the sublimation ink.

Examples of the water-soluble organic solvents include alcohols (for example, methanol, ethanol, propanol, pentanol, hexanol, cyclohexanol, benzyl alcohol), polyhydric alcohols (e.g., ethylene glycol, diethylene glycol, triethylene glycol, polyethylene glycol, propylene glycol, dipropylene glycol, tripropylene glycol, polypropylene glycol, glycerin, a compound represented by the later-described general formula (1)), polyhydric alcohol ethers (e.g., ethylene glycol monomethyl ether, ethylene glycol monoethyl ether, ethylene glycol monobutyl ether, ethylene glycol monophenyl ether, diethylene glycol monomethyl ether, diethylene glycol monoethyl ether, diethylene glycol monobutyl ether, diethylene glycol dimethyl ether, propylene glycol monomethyl ether, propylene glycol monoethyl ether), amines (e.g., ethanolamine, N-ethyldiethanolamine, morpholine, N-ethylmorpholine, ethylenediamine, diethylene diamine, triethylenetetramine), amides (e.g., formamide, N,N-dimethylformamide, N,N-dimethylacetamide), heterocycles (e.g., 2-pyrrolidone, N-methyl-2-pyrrolidone, N-cyclohexyl-2-pyrrolidone, 2-oxazolidone, 1,3-dimethyl-2-imidazolidine, sulfoxides (e.g., dimethyl sulfoxide), sulfones (e.g., sulfolane)).

[Chemical Formula 7]

General formula (1)

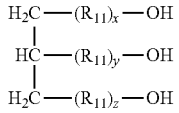

[In General Formula (1), $R_{11}$ all represent an ethylene glycol group or a propylene glycol group, x, y, and z are all positive integers, and x+y+z=3 to 30.]

From the viewpoint of promoting penetration of the sublimation ink into the fabric and from the viewpoint of suppressing a decrease in ejection stability in the inkjet method, it is preferable that the sublimation ink is less likely to thicken due to drying. Therefore, it is preferable that the sublimation ink contains a high-boiling point solvent having a boiling point of 200° C. or more among water-soluble organic solvents.

Examples of the high boiling point solvent having a boiling point of 200° C. or more include polyols and polyalkylene oxides. Examples of the polyols having a boiling point of 200° C. or higher include dihydric alcohols such as 1,3-butanediol (boiling point: 208° C.),1,6-hexanediol (boiling point: 223° C.), and polypropylene glycol. Examples of the polyols having a boiling point of 200° C. or higher include trihydric or higher alcohols such as glycerin (boiling point: 290° C.) and trimethylolpropane (boiling point: 295° C.). Examples of the polyalkylene oxides having a boiling point of 200° C. or higher include diethylene glycol monoethyl ether (boiling point: 202° C.), triethylene glycol monomethyl ether (boiling point: 245° C.), tetraethylene glycol monomethyl ether (boiling point: 305° C.), tripropylene glycol monoethyl ether (boiling point: 256° C.); and ethers of dihydric alcohols such as polypropylene glycol. Examples of the polyalkylene oxides having a boiling point of 200° C. or higher include ethers of trihydric or higher alcohols such as glycerin (boiling point: 290° C.) and hexanetriol.

The content of the water-soluble organic solvent is preferably within a range of 20 to 70% by mass with respect to the total mass of the sublimation ink. When the content of the water-soluble organic solvent is 20% by mass or more with respect to the total mass of the sublimation ink, the dispersibility of the sublimation coloring material and the ejection stability of the sublimation ink by an inkjet method are more likely to be enhanced. When the content is 70% by mass or less, the drying property of the sublimation ink is less likely to be impaired.

(4) Dispersant

The sublimation ink according to the present invention may further contain a dispersant. The dispersant is preferably selected according to the type of the sublimation coloring material.

Examples of the dispersant include a formalin condensate of sodium creosote oil sulfonate, a formalin condensate of sodium cresol sulfonate and sodium 2-naphthol-6-sulfonate, a formalin condensate of sodium cresol sulfonate, a formalin condensate of sodium phenol sulfonate, a formalin condensate of sodium β-naphthol sulfonate, a formalin condensate including sodium β-naphthalene sulfonate and sodium β-naphthol sulfonate and the like.

Examples of dispersants also include alkylene oxides including ethylene oxide and propylene oxide, fatty alcohols, fatty amines, fatty acids, phenols, alkylatable compounds including alkyl phenols and carboxylic amines. Further, examples of the dispersant include lignin sulfonate, sodium paraffin sulfonate, a copolymer of α-olefin and maleic anhydride, and a known comb-like block polymer.

Examples of the comb-shaped block polymer include "DISPERBYK (registered trademark)-190, 194 N, 2010, 2015" and "BYK (registered trademark)-154" (which are manufactured by BYK-Chemie GmbH).

The content of the dispersant is not particularly limited, but is preferably within a range of 20 to 200% by mass with respect to the total mass of the sublimation coloring material. When the content of the dispersant is 20% by mass or more, the dispersibility of the sublimation coloring material is more likely to be enhanced. When the content is 200% by mass or less, a decrease in ejection stability of the sublimation ink in an inkjet method is easily suppressed.

(5) Other Components

The sublimation ink according to the present invention may further contain other components than those described above as necessary. Examples of other components include a surfactant, a preservative, a pH adjuster, and the like. The same surfactants, preservatives, and pH adjusters as those in the treatment agent can be used.

(6) Physical Properties of Sublimation Ink

The viscosity at 25° C. of the sublimation ink according to the present invention is preferably adjusted as appropriate depending on the method of applying the sublimation ink to the fabric. For example, when the sublimation ink is applied to the fabric by the inkjet method, the viscosity of the sublimation ink is preferably in a range of 3 to 20 mPa s, and more preferably in a range of 4 to 12 mPa s.

Note that the viscosity of the sublimation ink can be measured using an E-type viscometer under a condition of 25° C.

6. Fabric Printing Method

The fabric printing method of the present invention is a printing method for printing the fabric with the sublimation coloring material, including the steps of: providing an aromatic heterocyclic compound I to the fabric, providing an aromatic heterocyclic compound II to the fabric, and providing the sublimation coloring material to the fabric, wherein the weight average molecular weight of the aromatic heterocyclic compound I is smaller than the weight average molecular weight of the aromatic heterocyclic compound II.

In addition, the fabric printing method of the present invention is the printing method for printing a fabric with a sublimation coloring material, the printing method including: a step of applying a coloring material scavenging compound to the fabric; a step of applying an ultraviolet absorber to the fabric; and a step of applying the sublimation coloring material to the fabric.

As described above, it is conceivable that the washing fastness of the finally obtained printed fabric can be improved by providing the aromatic heterocyclic compound or the like to the fabric in printing using a sublimation coloring material. The method of applying the aromatic heterocyclic compound or the like is not particularly limited, but it is preferable that the aromatic heterocyclic compound or the like be contained in the treatment agent, the sublimation ink, or the like and applied to the fabric.

The aromatic heterocyclic compounds I and II may not necessarily be contained in the same treatment agent, sublimation ink or the like. For example, two kinds of treatment agents, that is, a treatment agent 1 containing the aromatic heterocyclic compound I and a treatment agent 2 containing the aromatic heterocyclic compound II may be used in combination.

However, from the viewpoint that the steps can be simplified and printing can be performed at a high speed, it is preferable that the same treatment agent contains the aromatic heterocyclic compounds I and II.

The same applies to the coloring material scavenging compound and the ultraviolet absorber.

Furthermore, from the viewpoint that the above-described aromatic heterocyclic compound and the like can be previously incorporated into the inside of the fiber, it is preferable to incorporate the above-described aromatic heterocyclic compounds I and II into the same pretreatment agent. That is, it is preferable to use the above treatment agent as the pretreatment agent. When the aromatic heterocyclic compound or the like is incorporated into the fiber in advance, the sublimation coloring material to be applied later can be sufficiently captured.

Therefore, it is preferable that the fabric printing method according to the embodiment of the present invention has a step of applying the treatment agent to the fabric and a step of applying the sublimation coloring material to the fabric. Furthermore, it is more preferable to perform a step of applying a sublimation coloring material to the fabric after the step of applying the treatment agent to the fabric. However, in the present invention, the order of each step is not limited.

Next, each step will be described.

(1) Applying Fabric Treatment Agent to Fabric (Treatment Agent Applying Step)

By treating the fabric with the use of the treatment agent, the washing fastness of the printed fabric can be improved.

In particular, the effect is remarkable in fabric containing cellulose fiber, specifically, a natural fiber, a cellulose regenerated fiber, or the like.

The application of the treatment agent may be performed on the entire surface of the fabric, or may be selectively performed only on the region to be printed with the sublimation coloring material.

The method for applying the treatment agent is not particularly limited, and a known method can be used.

Examples of the method include a spray method, a mangle method (a pad method or a dipping method), a coating method, and an inkjet method.

From the viewpoint of performing continuously with the application of the sublimation ink in the sublimation coloring material application step described later, the inkjet method is preferable. Furthermore, from the viewpoint of applying a predetermined amount of the treatment agent in a short time, a mangle method or a coater method is preferable. For example, in the mangle method, the amount of the treatment agent to be applied can be adjusted by immersing the fabric in the treatment agent stored in a tub and then squeezing the fabric.

The temperature of the treatment agent is not particularly limited, but is preferably within a range of 15 to 30° C.

In a case where the treatment agent is applied by an inkjet method, it is preferable that the conditions of the treatment agent are the same as the conditions of the sublimation ink in the sublimation coloring material application step.

The application amount of the treatment agent is not particularly limited, but is preferably adjusted as appropriate according to the content of the aromatic heterocyclic compound and the like in the treatment agent, the application amount of the sublimation ink, and the like.

After the treatment agent is applied to the fabric, a step of removing the solvent from the coating film of the treatment agent on the fabric, that is, a step of drying the fabric may be performed. However, it is preferable that an appropriate amount of the solvent remains in the coating film of the treatment agent on the fabric.

The drying method is not particularly limited, but from the viewpoint that the solvent can be sufficiently removed in a short time, a method of drying with heat is preferable. The heating method is not particularly limited, and examples thereof include methods using warm air, a hot plate, or a heat roller.

The drying temperature is preferably within a range of 100 to 130° C.

(2) Applying Sublimation Coloring Material to Fabric (Sublimation Coloring Material Application Process)

The method of applying the sublimation coloring material is not particularly limited, and may be a sublimation transfer method, a direct method, or other methods. Among them, the sublimation transfer method is preferable from the viewpoint of dyeability and washing fastness.

The sublimation coloring material is preferably applied to the fabric as the aforementioned sublimation ink.

Hereinafter, printing on a fabric by a sublimation transfer method is also simply referred to as "sublimation transfer".

In the "sublimation transfer method", an image (transfer image) is formed on a transfer medium using a sublimation coloring material, and then the transfer medium and the fabric are heated and pressurized. Thus, the method refers to a method in which a vaporized sublimation coloring material is fixed to the fabric and then printing is performed.

The "direct method" refers to a method in which a sublimation coloring material is directly applied to a fabric, and then the fabric is heated to fix the vaporized sublimation coloring material to the fabric for dyeing.

(2.1) Sublimation Transfer Method

In the sublimation transfer method, the transfer image formed by applying the sublimation ink on the transfer medium is transferred to the fabric to which an appropriate amount of the treatment agent is applied and the image is printed on the fabric.

Note that an "image" generally refers to visually fixing an event on the medium. In the present invention, those dyed in one color as a whole, characters, patterns, pictures and the like are included therein.

In the sublimation transfer method, preferably, the transfer image is transferred to the fabric after the treatment agent is applied to the fabric. The transfer image may be prepared in parallel with the treatment agent application step or may be prepared in advance.

In the dyeing by the sublimation transfer method, first, the sublimation ink is applied onto the transfer medium and then dried to form a transfer image corresponding to the image to be formed on the fabric. The method for applying the sublimation ink is not particularly limited, but an inkjet method is preferably used because fabric printing can be performed with high accuracy.

The transfer medium is not particularly limited as long as it can form the transfer image on the surface of the transfer medium and can transfer the transfer image to the fabric. Specifically, any material may be used as long as it does not hinder the sublimation of the sublimation coloring material during the transfer. The transfer medium is preferably paper on the surface of which an ink receiving layer is formed by inorganic fine particles such as silica. Examples of the transfer medium include exclusive paper for inkjet printing and transfer paper.

Next, the surface of the transfer image on the transfer medium is brought into contact with the pretreated fabric, and heated and pressurized (heat-pressed). As a result, the sublimation coloring material included in the transfer image on the transfer medium is sublimation-transferred to the fabric, and the fabric is printed.

Methods for conveying the fabric during heating and pressurizing are roughly classified into a flat type and a continuous type (linear type), according to the shape of a member that performs heating and pressurizing. To perform heating and pressurization for each certain fixed area by using a flat type plate-like member. On the other hand, heating and pressurizing are continuously performed using a roll-shaped member in a continuous system.

In the present invention, a method for conveying the fabric during heating and pressurizing is not particularly limited. When dyeing a long fabric, for example, a fabric in the form of a roll, the continuous method is preferable from the viewpoint of suppressing color unevenness.

The transfer temperature (heat press temperature) is preferably adjusted as appropriate according to the sublimation temperature of the sublimation coloring material, and is preferably in a range of, for example, 180 to 210° C. The pressing force is preferably within a range of 200 to 500 g/cm 2 in a case of a flat type, and within a range of 2 to 6 kg/cm 2 in a case of a continuous type. The pressing time is preferably adjusted as appropriate according to the transfer temperature and the pressing pressure, and is preferably within a range of 30 seconds to 180 seconds, for example.

(2.2) Direct Method

After the sublimation ink is directly applied to the fabric by the direct method, the fabric is heated to fix the vaporized sublimation coloring material to the fabric for dyeing.

The temperature of the surface of the fabric when the sublimation ink is applied is preferably in a range of 35 to 70° C. from the viewpoint of suppressing bleeding.

The method for directly applying the sublimation ink to the fabric is not particularly limited, and a known method can be used. Examples of the method for directly applying the sublimation ink to the fabric include a spraying method, a mangle method (a pad method or a dipping method), a coating method, and an inkjet method.

In addition, a method for heating the fabric is not particularly limited, known methods can be used, and examples thereof include warm air, an electric heater, an infrared heater, and the like. In addition, the various heaters may have a plate shape or a roller shape.

The heating temperature is preferably adjusted as appropriate according to the sublimation temperature of the sublimation coloring material, and is preferably in a range of, for example, 95 to 220° C.

7. Fabric Printing Apparatus

The fabric printing apparatus of the present invention is a fabric printing apparatus for printing on the fabric with the sublimation coloring material, including means for applying an aromatic heterocyclic compound I to the fabric, means for applying an aromatic heterocyclic compound II to the fabric, and means for applying the sublimation coloring material to the fabric, wherein the weight average molecular weight of the aromatic heterocyclic compound I is smaller than the weight average molecular weight of the aromatic heterocyclic compound II.

Furthermore, the fabric printing apparatus of the present invention is the fabric printing apparatus for printing on the fabric with the sublimation coloring material, and includes a means for applying the coloring material scavenging compound to the fabric, a means for applying the ultraviolet absorber to the fabric, and a means for applying the sublimation coloring material to the fabric.

In addition, it is preferable that the fabric printing apparatus of the present invention has a unit which applies the treatment agent to the fabric and a unit which applies the sublimation coloring material to the fabric. Hereinafter, the fabric printing apparatus for fabric is also simply referred to as a "printing apparatus".

A means for applying the treatment agent to the fabric is not particularly limited, and a known means can be used.

Examples of the means for applying the sublimation coloring material to the fabric include the printing apparatus using the sublimation transfer method and the printing apparatus using the direct method.

(1) Sublimation Transfer Method

FIG. 1 is a schematic diagram of the textile printing apparatus (sublimation transfer method) of the present invention.

FIG. 1 shows an example of a case where all of the means for applying the treatment agent to the fabric, the means for drying the fabric, and the means for applying the sublimation coloring material to the fabric are mounted on one apparatus. However, the configuration of the printing apparatus of the present invention is not limited thereto. For example, separate devices may be provided for the respective means. In addition, means for drying the fabric may not necessarily be provided.

The printing apparatus 400 illustrated in FIG. 1 includes a treatment agent applying section 103 as a means for applying the treatment agent to the fabric, and a treatment agent drying section 104 as a means for drying the fabric. The textile printing apparatus 400 includes an inkjet recording section 203, an ink drying section 204, and a transfer section 301 as means for applying the sublimation coloring material to the fabric. In addition, as illustrated in FIG. 1, the printing apparatus 400 may include, for example, other components or devices such as a peeling section 302, a fabric conveyance section 102, and a transfer medium conveyance section 202, as necessary.

Hereinafter, the printing apparatus 400 illustrated in FIG. 1 will be described in detail.

Figure 3:
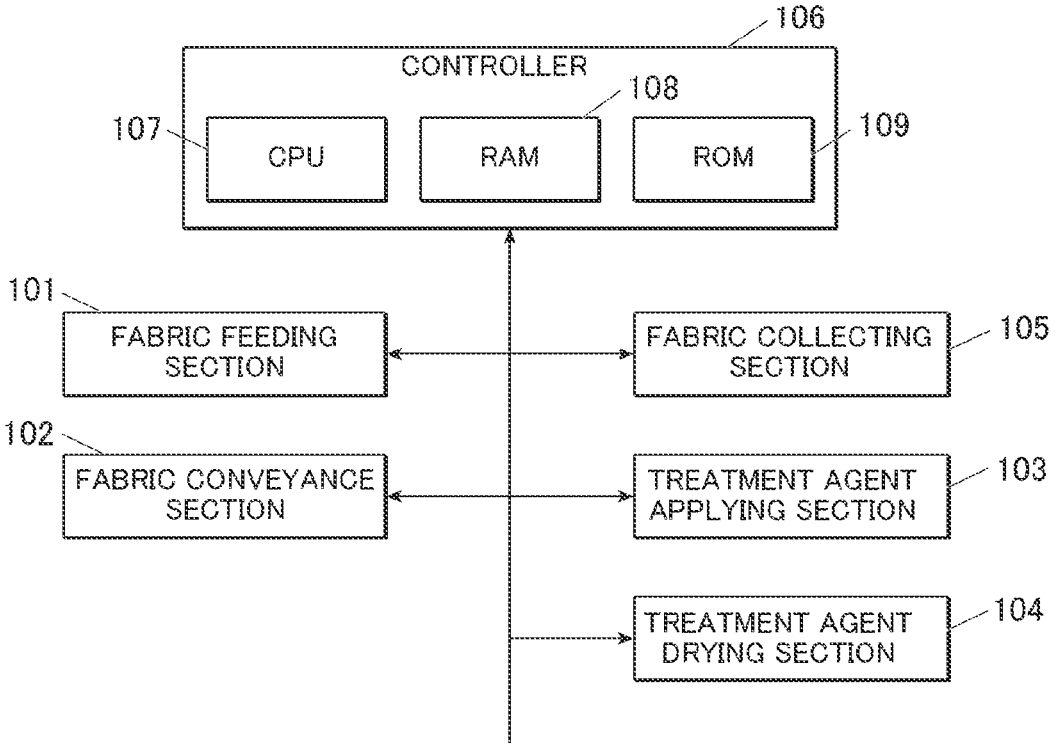
FIG. 3 is a schematic diagram showing a configuration for controlling the application condition of the treatment agent based on the fabric information.

The printing apparatus 400 transports fabric C from a fabric feeding section 101 to the treatment agent applying section 103 and applies the treatment agent to the fabric in the treatment agent applying section 103 under the control of the controller 106 shown in FIG. 3. The fabric C1 to which an appropriate amount or more of the treatment agent has been applied is further transported to the treatment agent drying section 104, and the fabric is dried in the treatment agent drying section 104. The fabric C2 to which the appropriate amount of treatment agent has been applied is conveyed to the transfer section 301. Next, in the transfer section 301, the fabric C2 to which the appropriate amount of the treatment agent has been applied and the transfer medium P2 on which the transfer image has been formed are heated and pressurized to perform sublimation transfer. Thereafter, the printed fabric N and the transfer media P3 after the heating and the pressurizing are released from each other in the peeling section 302, and the printed fabric N is collected in a fabric collecting section 105.

The fabric C is installed in the fabric feeding section 101 provided on the upstream side of the treatment agent applying section 103 in the conveyance direction. The fabric feeding section 101 includes a rotation shaft to which the fabric C in a roll form is attached, a motor (not illustrated) that rotationally drives the rotation shaft in a predetermined rotation direction, and the like. The fabric feeding section 101 feeds the fabric C to the downstream side in the conveyance direction along the rotation of the rotation shaft by driving the motor.

The fabric conveyance section 102 conveys the fabric C fed from the fabric feeding section 101. In FIG. 1, a configuration is adopted in which the fabric C is conveyed by a conveyance roller, but a configuration may be adopted in which the fabric C is conveyed by being attached to a conveyance belt, for example.

The fabric collecting section 105 is provided on the downstream side of the peeling section 302, and collects the printed fabric N while winding it up.

FIG. 3 is a block diagram illustrating a configuration for controlling conditions for applying the treatment agent based on fabric information.

The controller 106 controls conditions for applying the treatment agent based on the fabric information. Specifically, it is preferable to control the application amount of the treatment agent based on the fabric information.

Fabric information input when a user operates an operation part (not illustrated) is input to the controller 106. Examples of the fabric information include a fiber ratio, a basis weight, and a fiber type of the fabric.

The controller 106 includes a CPU 107, RAM 108, ROM 109, and the like. The processor CPU 107 reads various programs, data, and the like corresponding to processing content from a computer data storage such as the processor ROM 109 and executes the programs. Then, the operation of each section of the printing apparatus 400 is controlled according to the executed processing content. The RAM 108 temporarily stores various programs, data, and the like to be processed by the CPU 107. The ROM 109 stores various programs, data, and the like read by the CPU 107 and the like.

Specifically, the controller 106 performs the following processing on the printing apparatus 400.

The controller 106 operates the treatment agent applying section 103 so that the application amount of the treatment agent becomes a predetermined amount according to the fabric information input from the operation part (not illustrated), and applies the treatment agent to the fabric C. As the fabric information, for example, it is preferable to control the application amount of the treatment agent according to the fiber ratio (specifically, the polyester fiber ratio) of the fabric C.

In addition, for example, data of the application amount of the treatment agent corresponding to the fiber ratio of the fabric C is stored in the ROM 109. The application amount data of the treatment agent is preferably data calculated from a mathematical expression based on the fiber ratio or data on the application amount based on a threshold value of the fiber ratio.

Examples of the formula include, but are not limited to, those represented by the following expression.

$$y=-ax+100a \quad \text{(Expression)}$$

[In the above formula, y represents an application amount [g/m$^2$], x represents a polyester fiber ratio (0 to 100% by mass), and a represents an inclination (for example, a=0.4 [g/m$^2$]).]

Regarding the data of the application amount based on the threshold value of the fiber ratio, for example, in a case where the polyester fiber ratio in the fabric is 0% by mass or more and less than 40% by mass, the application amount is preferably set as 40 g/m$^2$. In addition, in a case where the polyester fiber ratio is 40% by mass or more and less than 80% by mass, the application amount is preferably 20 g/m$^2$.

In addition, it is preferable that the data of the application amount based on the mathematical expression or the threshold value is corrected by, for example, weight per unit area.

Specifically, it is desirable to increase the application amount as the weight per unit area increases.

The printing apparatus 400 conveys the transfer medium P from the transfer medium feeding section 201 to the inkjet recording section 203, and applies the sublimation ink to the transfer medium in the inkjet recording section 203. A transfer medium P1 with the sublimation ink applied thereto is further conveyed to the ink drying section 204, and the fabric is dried in the ink drying section 204. Transfer medium P2 on which the transfer image is formed is conveyed to the transfer section 301. Next, in the transfer section 301, the fabric C2 to which the appropriate amount of the treatment agent has been applied and the transfer medium P2 on which the transfer image has been formed are heated and pressurized to perform sublimation transfer. Thereafter, the printed fabric N and the transfer medium P3 after the heating and the pressurizing are peeled off from each other in the peeling section 302, and the transfer medium P3 after the heating and the pressurizing is collected in the transfer medium collecting section 205.

A roll-shaped transfer medium P is mounted on the transfer medium feeding section 201. The transfer medium P is fed out by driving a motor (not illustrated). Next, the inkjet recording section 203 is mounted so that the transfer surface of the transfer medium P faces the inkjet head of the inkjet recording section 203. Here, the "transfer surface" refers to a surface on which a transfer image is formed.

The inkjet recording section 203 applies the sublimation ink onto the transfer medium P fed from the transfer medium feeding section 201, using the inkjet head.

The ink drying section 204 is provided on the downstream side of the inkjet recording section 203 and dries the transfer medium P1 to which the sublimation ink has been applied.

The transfer section 301 preferably includes, for example, a heating roller 301*a* having a heat source therein and a pressure roller 301*b* made to have pressed contact with the heating roller 301*a*. By adopting such a configuration, sublimation transfer can be performed by continuously applying heat and pressure.

Figure 4:
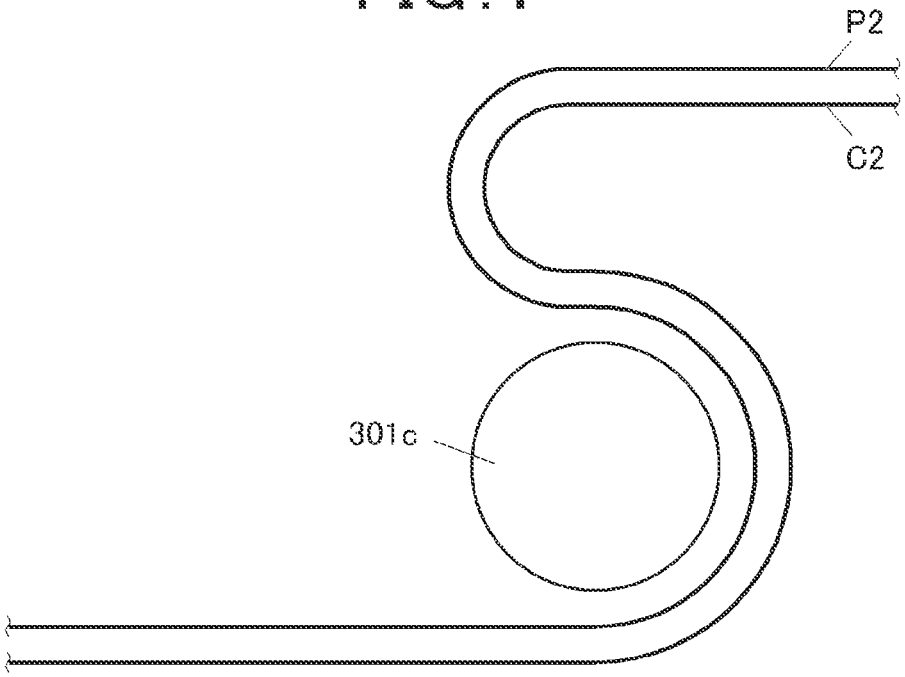
FIG. 4 is a schematic diagram of a heating roller in a sublimation transfer method.

Note that as illustrated in FIG. 1, the transfer section 301 may have a configuration in which the fabric C2 to which an appropriate amount of treatment agent has been applied and the transfer medium P2 on which the transfer image has been formed are sandwiched between a heating roller 301*a* and a pressure roller 301*b*. In addition, as shown in FIG. 4, a configuration may be adopted in which the fabric C2 to which an appropriate amount of the treatment agent is applied and the transfer medium P2 on which the transfer image is formed are wound around the heating roller 301*c*.

The fabric C2 to which an appropriate amount of the treatment agent has been applied and the transfer medium P2 on which the transfer image has been formed are superimposed so as to be in contact with each other at the transfer surface. Next, the fabric C2 and the transfer medium P2 in the stacked state pass through a nip part between a heating roller 301*a* and a pressure roller 301*b*. Thus, the stacked state of the fabric C2 provided with an appropriate amount of the treatment agent and the transfer medium P2 on which the transfer image is formed is subjected to heating and pressurizing treatment. Then, the transfer image on the transfer medium P2 is sublimated and transferred to the fabric C2 to which an appropriate amount of the treatment agent is applied, and the fabric C2 becomes the printed fabric N.

The peeling section 302 is provided on a downstream side of the transfer section 301. The peeling section 302 peels the transfer medium P3 after heating and pressurizing from the stacked state after heating and pressurizing to obtain the printed fabric N.

The transfer medium collecting section 205 is provided on the downstream side of the peeling section 302.

The used transfer medium P3 after heating and pressurizing, which has been peeled off from the stacked state in the peeling section 302, is collected while being wound up.

(2) Direct Method

Figure 2:
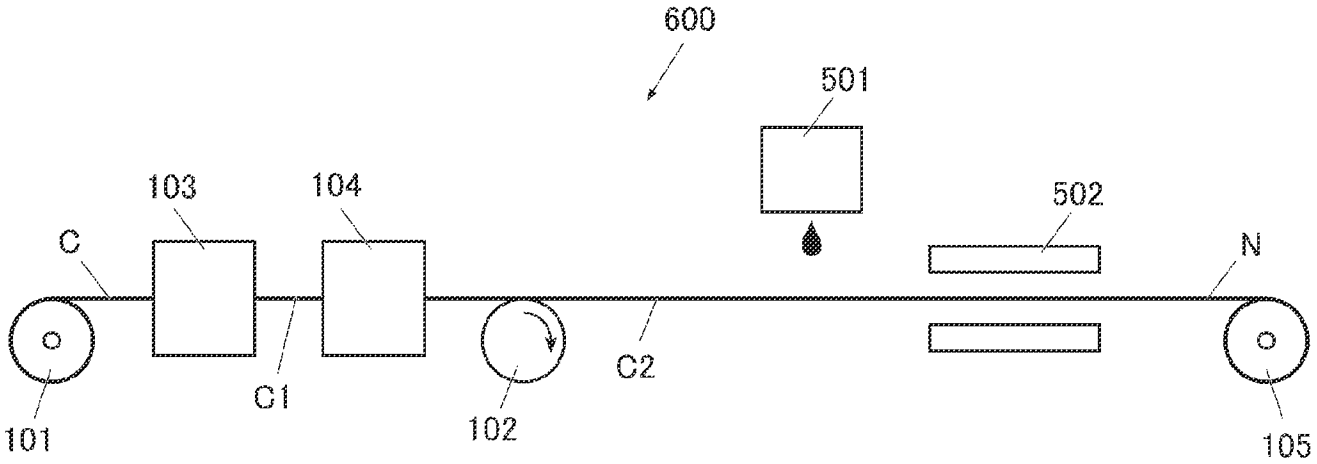
FIG. 2 is a schematic diagram of the fabric printing apparatus for fabric (direct method) of the present invention.

FIG. 2 is a schematic diagram of the printing apparatus (direct method) according to the present invention.

FIG. 2 shows an example of a case where all of the means for applying the treatment agent to the fabric, the means for drying the fabric, and the means for applying the sublimation coloring material to the fabric are mounted on one apparatus. However, the configuration of the printing apparatus of the present invention is not limited thereto. For example, separate devices may be provided for the respective means. In addition, means for drying the fabric may not necessarily be provided.

The printing apparatus 600 illustrated in FIG. 2 includes a treatment agent applying section 103 as a means for applying the treatment agent to the fabric, and a treatment agent drying section 104 as a means for drying the fabric. The textile printing apparatus 600 includes an inkjet recording section 501, and an ink heating section 502 as means for applying the sublimation coloring material to the fabric. In addition, as illustrated in FIG. 2, the printing apparatus 600 may include, for example, other components or devices such as a fabric conveyance section 102, as necessary.

Examples of the heat source used for the ink heating section 502 include an electric heater and an infrared heater. The shape is not particularly limited, and may be a plate shape or a roll shape.

8. Printed Fabric

The printed fabric of the present invention is a printed fabric containing a sublimation coloring material, and contains an aromatic heterocyclic compound I and an aromatic heterocyclic compound II, wherein a weight average molecular weight of the aromatic heterocyclic compound I is smaller than a weight average molecular weight of the aromatic heterocyclic compound II.

That is, the printed fabric of the present invention is characterized by containing two kinds of aromatic heterocyclic compounds having different weight average molecular weights.

In addition, a printed fabric according to an embodiment of the present invention contains a sublimation coloring material, in which the printed fabric contains a coloring material scavenging compound and an ultraviolet absorber.

Since the printed fabric according to the embodiment of the present invention contains the aromatic heterocyclic compound or the like, the washing fastness is improved.

The method for producing the printed fabric according to the embodiment of the present invention is not particularly limited, but it is preferable that the printed fabric is produced using the treatment agent, the fabric printing method, and the printing apparatus as described above.

In the present invention, the "printed fabric containing an aromatic heterocyclic compound" means that the aromatic heterocyclic compound or the like is present so as to fill gaps between fibers constituting the fabric. "Printed fabric containing a coloring material scavenging compound and an ultraviolet absorber" and "printed fabric containing a sublimation coloring material" also mean that the aromatic heterocyclic compound or the like and the sublimation coloring material are present so as to fill gaps between fibers constituting the fabric. Specifically, the state refers to a state where the aromatic heterocyclic compound or the like and the sublimation coloring material are physically adsorbed to the fiber. Furthermore, it refers to a state where the fiber, the aromatic heterocyclic compound or the like, and the sublimation coloring material are chemically bonded to each other, that is, a state of chemical adsorption.

EXAMPLES

Hereinafter, the present invention will be specifically described with reference to Examples, but the present invention is not limited thereto. In Examples, "part (s)" or "%" means "part (s) by mass" or "% by mass" unless otherwise specified.

In the following examples, the operation was performed at room temperature (25° C.) unless otherwise noted.

1. Preparation of Fabric Treatment Agent

The following components were mixed under stirring to prepare a fabric treatment agent 1.

- 2-(2,4-dihydroxyphenyl)-4,6-diphenyl-1, 3,5-triazine (compound I (a)) 3.0 parts by mass
- 5,5'-(1,3-phenylene) bis (3-phenyl-1h-pyrazole) (compound II (a)) 10.0 parts by mass
- dimethyl sulfoxide (I/O value: 1.75) 70.0 parts by mass
- Ion-exchanged water remainder (amount such that total amount is 100% by mass)
- The I/O value of dimethyl sulfoxide was calculated by the above-described method.

The types and contents of the aromatic heterocyclic compound and the organic solvent were changed as shown in Table I or Table II. Except for the above, fabric treatment agents 2 to 13, 22 to 34, and 101 to 104 were prepared in the same manner as the method for preparing the fabric treatment agent 1 Note that "–" indicates that none is contained.

The following components were mixed under stirring to prepare a fabric treatment agent 14.

- 2-(2,4-dihydroxyphenyl)-4,6-diphenyl-1, 3,5-triazine (compound I (a)) 3.0 parts by mass
- 5,5'-(1,3-phenylene) bis (3-phenyl-1h-pyrazole) (compound II (a)) 10.0 parts by mass
- dimethyl sulfoxide (I/O value: 1.75) 70.0 parts by mass
- Adekastab AO-60 (phenol-based antioxidant, manufactured by ADEKA Corporation) 0.5 parts by mass
- Ion-exchanged water remainder (amount such that total amount is 100% by mass)
- The I/O value of dimethyl sulfoxide was calculated by the above-described method.

The content of the antioxidant and the type of the aromatic heterocyclic compound were changed as shown in Table I or Table II. Except for the above, treatment agents 15 to 21 and 35 to 42 for a fabric were prepared in the same manner as in the method for preparing the fabric treatment agent 14.

The aromatic heterocyclic compound, the organic solvent, and the antioxidant used in the preparation of the treatment agent for the fabric are as follows.

It was confirmed that the aromatic heterocyclic compound I used also corresponds to the ultraviolet absorber according to the present invention. In addition, it was confirmed that all of the aromatic heterocyclic compounds II had an Rf value of 0.7 or less as determined by the paper chromatography method described above and also correspond to the coloring material scavenging compound according to the embodiment of the present invention. Note that in the paper chromatography method, Disperse Red 60 was used as the sublimation coloring material.

(Aromatic Heterocyclic Compound I)

- Compound I (a): 2-(2, 4-dihydroxyphenyl)-4,6-diphenyl-1, 3,5-triazine, weight average molecular weight: 341.
- Compound I (b): 4-(2-hydroxyethyl)-3-methyl-2-pyrazoline-5-one, weight average molecular weight: 142
- Compound I (c): 4-hydroxymethyl-1H-1, 2,3-triazole-1-ethyl acetate, weight average molecular weight: 185
- Compound I (d): 2-methylbenzimidazole, weight average molecular weight: 132
- Compound I (e): 2-(2-hydroxy-5-tert-octylphenyl) benzotriazole, weight average molecular weight: 323 (Aromatic Heterocyclic Compound II)
- Compound II (a): 5-,-5'-(1,3-phenylen) bis (3-phenyl-1H pyrazole), "KPY01" (manufactured by Konica Minolta, Inc), weight average molecular weight: 363, Rf value: 0.36.
- Compound II (b): 5-,-5', 5"-(1, 3,5-phenylen) tris (3-phenyl-4,5-dihydro-1H-pyrazole), "KPY02" (manufactured by Konica Minolta Inc), weight average molecular weight: 546, Rf value: 0.18.

[Chemical Formula 8]

COMPOUND I (a)

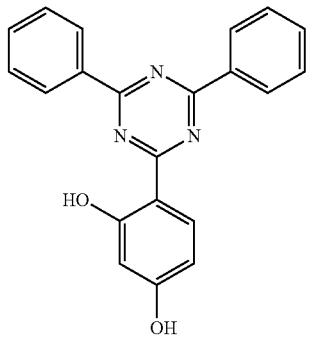

COMPOUND I (b)

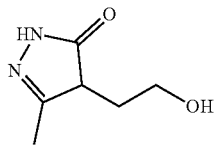

-continued

COMPOUND I (c)

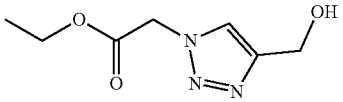

COMPOUND I (d)

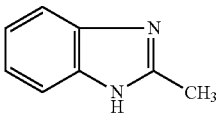

COMPOUND I (e)

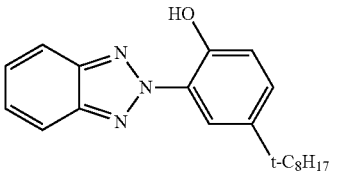

[Chemical Formula 9]

COMPOUND II (a)

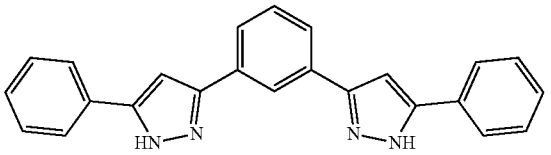

-continued

COMPOUND II (b)

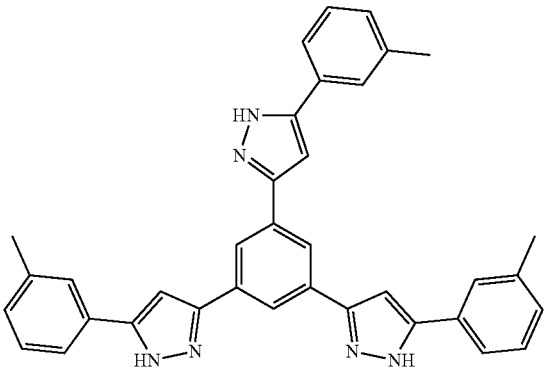

(Organic Solvent)

DMSO: Dimethyl sulfoxide, I/O value: 1.75

DPGME: Dipropylene glycol monomethyl ether, I/O value: 1.00

PG: Propylene glycol, I/O value: 3.33

DPGDME: Dipropylene glycol dimethyl ether, I/O value: 0.38

EG: Ethylene glycol, I/O value: 5.00

(Antioxidant)

AO-60: "Adekastab AO-60" (phenol-based antioxidant, manufactured by ADEKA Corporation)

Tables I and II show the constitution of each fabric treatment agent.

"Molecular weight (Mw)" in the table means the weight average molecular weight measured by the above-described method.

TABLE 1

TABLE I

| FABRIC | AROMATIC HETEROCYCLIC COMPOUND I | | | AROMATIC HETEROCYCLIC COMPOUND II | | |
|---|---|---|---|---|---|---|
| TREATMENT AGENT No. | TYPE | MOLECULAR WEIGHT (Mw) | CONTENT [% BY MASS] | TYPE | MOLECULAR WEIGHT (Mw) | CONTENT [% BY MASS] |
| 1 | COMPOUND I(a) | 341 | 3.0 | COMPOUND II(a) | 363 | 10.0 |
| 2 | COMPOUND I(a) | 341 | 3.0 | COMPOUND II(a) | 363 | 10.0 |
| 3 | COMPOUND I(a) | 341 | 3.0 | COMPOUND II(a) | 363 | 10.0 |
| 4 | COMPOUND I(a) | 341 | 3.0 | COMPOUND II(a) | 363 | 10.0 |
| 5 | COMPOUND I(a) | 341 | 3.0 | COMPOUND II(a) | 363 | 10.0 |
| 6 | COMPOUND I(a) | 341 | 1.0 | COMPOUND II(a) | 363 | 10.0 |
| 7 | COMPOUND I(a) | 341 | 5.0 | COMPOUND II(a) | 363 | 10.0 |
| 8 | COMPOUND I(a) | 341 | 0.5 | COMPOUND II(a) | 363 | 10.0 |
| 9 | COMPOUND I(a) | 341 | 10.0 | COMPOUND II(a) | 363 | 10.0 |
| 10 | COMPOUND I(a) | 341 | 3.0 | COMPOUND II(a) | 363 | 1.0 |
| 11 | COMPOUND I(a) | 341 | 3.0 | COMPOUND II(a) | 363 | 30.0 |
| 12 | COMPOUND I(a) | 341 | 3.0 | COMPOUND II(a) | 363 | 0.5 |
| 13 | COMPOUND I(a) | 341 | 3.0 | COMPOUND II(a) | 363 | 40.0 |
| 14 | COMPOUND I(a) | 341 | 3.0 | COMPOUND II(a) | 363 | 10.0 |

TABLE 1-continued

TABLE I

| | | | | | | |
|---|---|---|---|---|---|---|
| 15 | COMPOUND I(a) | 341 | 3.0 | COMPOUND II(a) | 363 | 10.0 |
| 16 | COMPOUND I(a) | 341 | 3.0 | COMPOUND II(a) | 363 | 10.0 |
| 17 | COMPOUND I(a) | 341 | 3.0 | COMPOUND II(a) | 363 | 10.0 |
| 18 | COMPOUND I(b) | 142 | 3.0 | COMPOUND II(a) | 363 | 10.0 |
| 19 | COMPOUND I(c) | 185 | 3.0 | COMPOUND II(a) | 363 | 10.0 |
| 20 | COMPOUND I(d) | 132 | 3.0 | COMPOUND II(a) | 363 | 10.0 |
| 21 | COMPOUND I(e) | 323 | 3.0 | COMPOUND II(a) | 363 | 10.0 |
| 101 | — | — | — | — | — | — |
| 102 | COMPOUND I(a) | 341 | 3.0 | — | — | — |
| 103 | — | | — | COMPOUND II(a) | 363 | 10.0 |

| FABRIC TREATMENT | ORGANIC SOLVENT | | | ANTIOXIDANT | | ION-EXCHANGED WATER |
|---|---|---|---|---|---|---|
| AGENT No. | TYPE | I/O VALUE | CONTENT [% BY MASS] | TYPE | CONTENT [% BY MASS] | CONTENT [% BY MASS] |
| 1 | DMSO | 1.75 | 70.00 | — | — | REMAINDER |
| 2 | DPGME | 1.00 | 70.00 | — | — | REMAINDER |
| 3 | PG | 3.33 | 70.00 | — | — | REMAINDER |
| 4 | DPGDME | 0.38 | 70.00 | — | — | REMAINDER |
| 5 | EG | 5.00 | 70.00 | — | — | REMAINDER |
| 6 | DMSO | 1.75 | 70.00 | — | — | REMAINDER |
| 7 | DMSO | 1.75 | 70.00 | — | — | REMAINDER |
| 8 | DMSO | 1.75 | 70.00 | — | — | REMAINDER |
| 9 | DMSO | 1.75 | 70.00 | — | — | REMAINDER |
| 10 | DMSO | 1.75 | 70.00 | — | — | REMAINDER |
| 11 | DMSO | 1.75 | 60.00 | — | — | REMAINDER |
| 12 | DMSO | 1.75 | 70.00 | — | — | REMAINDER |
| 13 | DMSO | 1.75 | 55.00 | — | — | REMAINDER |
| 14 | DMSO | 1.75 | 70.00 | AO-60 | 0.5 | REMAINDER |
| 15 | DMSO | 1.75 | 70.00 | AO-60 | 3.0 | REMAINDER |
| 16 | DMSO | 1.75 | 70.00 | AO-60 | 0.1 | REMAINDER |
| 17 | DMSO | 1.75 | 70.00 | AO-60 | 5.0 | REMAINDER |
| 18 | DMSO | 1.75 | 70.00 | AO-60 | 2.0 | REMAINDER |
| 19 | DMSO | 1.75 | 70.00 | AO-60 | 2.0 | REMAINDER |
| 20 | DMSO | 1.75 | 70.00 | AO-60 | 2.0 | REMAINDER |
| 21 | DMSO | 1.75 | 70.00 | AO-60 | 2.0 | REMAINDER |
| 101 | DMSO | 1.75 | 70.00 | — | — | REMAINDER |
| 102 | DMSO | 1.75 | 70.00 | — | — | REMAINDER |
| 103 | DMSO | 1.75 | 70.00 | — | — | REMAINDER |

TABLE 2

TABLE II

| FABRIC | AROMATIC HETEROCYCLIC COMPOUND I | | | AROMATIC HETEROCYCLIC COMPOUND II | | |
|---|---|---|---|---|---|---|
| TREATMENT AGENT No. | TYPE | MOLECULAR WEIGHT (Mw) | CONTENT [% BY MASS] | TYPE | MOLECULAR WEIGHT (Mw) | CONTENT [% BY MASS] |
| 22 | COMPOUND I(a) | 341 | 3.0 | COMPOUND II(b) | 546 | 10.0 |
| 23 | COMPOUND I(a) | 341 | 3.0 | COMPOUND II(b) | 546 | 10.0 |
| 24 | COMPOUND I(a) | 341 | 3.0 | COMPOUND II(b) | 546 | 10.0 |
| 25 | COMPOUND I(a) | 341 | 3.0 | COMPOUND II(b) | 546 | 10.0 |
| 26 | COMPOUND I(a) | 341 | 3.0 | COMPOUND II(b) | 546 | 10.0 |
| 27 | COMPOUND I(a) | 341 | 1.0 | COMPOUND II(b) | 546 | 10.0 |

TABLE 2-continued

TABLE II

| | | | | | | |
|---|---|---|---|---|---|---|
| 28 | COMPOUND I(a) | 341 | 5.0 | COMPOUND II(b) | 546 | 10.0 |
| 29 | COMPOUND I(a) | 341 | 0.5 | COMPOUND II(b) | 546 | 10.0 |
| 30 | COMPOUND I(a) | 341 | 10.0 | COMPOUND II(b) | 546 | 10.0 |
| 31 | COMPOUND I(a) | 341 | 3.0 | COMPOUND II(b) | 546 | 1.0 |
| 32 | COMPOUND I(a) | 341 | 3.0 | COMPOUND II(b) | 546 | 30.0 |
| 33 | COMPOUND I(a) | 341 | 3.0 | COMPOUND II(b) | 546 | 0.5 |
| 34 | COMPOUND I(a) | 341 | 3.0 | COMPOUND II(b) | 546 | 40.0 |
| 35 | COMPOUND I(a) | 341 | 3.0 | COMPOUND II(b) | 546 | 10.0 |
| 36 | COMPOUND I(a) | 341 | 3.0 | COMPOUND II(b) | 546 | 10.0 |
| 37 | COMPOUND I(a) | 341 | 3.0 | COMPOUND II(b) | 546 | 10.0 |
| 38 | COMPOUND Ka) | 341 | 3.0 | COMPOUND II(b) | 546 | 10.0 |
| 39 | COMPOUND I(b) | 142 | 3.0 | COMPOUND II(b) | 546 | 10.0 |
| 40 | COMPOUND Kc) | 185 | 3.0 | COMPOUND II(b) | 546 | 10.0 |
| 41 | COMPOUND I(d) | 132 | 3.0 | COMPOUND II(b) | 546 | 10.0 |
| 42 | COMPOUND I(e) | 323 | 3.0 | COMPOUND II(b) | 546 | 10.0 |
| 104 | — | — | — | COMPOUND II(b) | 546 | 10.0 |

| FABRIC TREATMENT | ORGANIC SOLVENT | | | ANTIOXIDANT | | ION-EXCHANGED WATER |
|---|---|---|---|---|---|---|
| AGENT No. | TYPE | I/O VALUE | CONTENT [% BY MASS] | TYPE | CONTENT [% BY MASS] | CONTENT [% BY MASS] |
| 22 | DMSO | 1.75 | 70.00 | — | — | REMAINDER |
| 23 | DPGME | 1.00 | 70.00 | — | — | REMAINDER |
| 24 | PG | 3.33 | 70.00 | — | — | REMAINDER |
| 25 | DPGDME | 0.38 | 70.00 | — | — | REMAINDER |
| 26 | EG | 5.00 | 70.00 | — | — | REMAINDER |
| 27 | DMSO | 1.75 | 70.00 | — | — | REMAINDER |
| 28 | DMSO | 1.75 | 70.00 | — | — | REMAINDER |
| 29 | DMSO | 1.75 | 70.00 | — | — | REMAINDER |
| 30 | DMSO | 1.75 | 70.00 | — | — | REMAINDER |
| 31 | DMSO | 1.75 | 70.00 | — | — | REMAINDER |
| 32 | DMSO | 1.75 | 60.00 | — | — | REMAINDER |
| 33 | DMSO | 1.75 | 70.00 | — | — | REMAINDER |
| 34 | DMSO | 1.75 | 55.00 | — | — | REMAINDER |
| 35 | DMSO | 1.75 | 70.00 | AO-60 | 0.5 | REMAINDER |
| 36 | DMSO | 1.75 | 70.00 | AO-60 | 3.0 | REMAINDER |
| 37 | DMSO | 1.75 | 70.00 | AO-60 | 0.1 | REMAINDER |
| 38 | DMSO | 1.75 | 70.00 | AO-60 | 5.0 | REMAINDER |
| 39 | DMSO | 1.75 | 70.00 | AO-60 | 2.0 | REMAINDER |
| 40 | DMSO | 1.75 | 70.00 | AO-60 | 2.0 | REMAINDER |
| 41 | DMSO | 1.75 | 70.00 | AO-60 | 2.0 | REMAINDER |
| 42 | DMSO | 1.75 | 70.00 | AO-60 | 2.0 | REMAINDER |
| 104 | DMSO | 1.75 | 70.00 | — | — | REMAINDER |

2. Preparation Of Sublimation Inks (Preparation of Dispersion Liquid)

DISPERBYK-190 (manufactured by BYK Chemie GmbH, acid value 10 mgKOH/g) as a dispersant and ion-exchanged water were stirred and mixed until uniform. Thereafter, Disperse Red 60 was added as a sublimation coloring material and premixed. Then, the mixture was dispersed until the Z-average particle size measured by a dynamic light scattering method was in the range of 150 to 200 nm to prepare a dispersion liquid in which the concentration of the sublimation coloring material was 20% by weight. At this time, the addition amounts of the dispersant, the ion-exchanged water, and the sublimation coloring material were adjusted such that the content of the sublimation coloring material was 20% by mass with respect to the total mass of the dispersion liquid and the content of the solid content of the dispersant was 30% by mass with respect to the total mass of the sublimation coloring material.

The measurement of the Z-average particle size by the dynamic light scattering method was performed using a sand grinder "Zetasizer (registered trademark) 1000" (manufactured by Malvern Panalytical). filled with 0.5 mm zirconia beads at a volume fraction of 50%.

(Preparation of Ink)

Glycerin, ethylene glycol, ion-exchanged water, Proxel GXL (manufactured by Lonza Japan Ltd) as a preservative and sodium citrate hydrate as a pH adjuster were added in appropriate amounts in the obtained dispersion liquid. The addition amounts were adjusted so that the contents with respect to the total mass of the sublimation ink were 30% by mass of the dispersion liquid, 10% by mass of glycerin as the solvent, and 25% by mass of ethylene glycol. Thereafter, the obtained result was filtered through a 1-μm mesh filter to obtain a magenta sublimation ink.

3. Printing on Fabric (1) Pretreatment to Fabric (Treatment Agent Application Step)

Cotton broadcloth 40 (cotton 100%) was used as the fabric. Then, the fabric was immersed in the tub filled with the fabric treatment agent prepared as described above. Thereafter, the excess treatment agent was squeezed by a mangle roll at a pickup rate of 80%. The temperature in the tub was set to be within a range of 20 to 25° C. The "pick-up rate" here refers to the ratio of the application amount of the treatment agent to the mass of the fabric.

(2) Sublimation Transfer to Fabric (Sublimation Coloring Material Application Step)

(2.1) Application of Sublimation Ink to Transfer Paper

Next, an inkjet printer having an inkjet head "KM1024iMAE" (manufactured by Konica Minolta, Inc) was prepared as the printing apparatus. The sublimation ink prepared as described above was jetted from the nozzle of the inkjet head to form a solid image on A4-sized sublimation transfer paper with glue (manufactured by System-Graphi Co., Ltd) as the transfer paper.

To be specific, in the main scanning 540 dpi×sub-scanning 720 dpi, an image (200 mm×200 mm as a whole) including a fine line grid, gradation, and a solid portion was formed. Dpi represents the number of ink droplets (dots) per 2.54 cm. The ejection frequency was set to 22.4 kHz. Thereafter, the transfer paper to which the ink was applied was dried for 30 seconds in a range of 50 to 80° C. by the dryer.

(2.2) Transfer of Sublimation Ink to Fabric

Next, the transfer paper to which the sublimation ink is applied and the pretreated fabric are subjected to thermo-compression bonding at 200° C. for 50 seconds at a press pressure 300 g/cm$^2$ by using a transfer device (heat press machine), and the printed fabric is obtained.

[Evaluation]

The resulting printed fabrics were evaluated as below.

<Dyeability>

L*, a* and b* of the obtained printed fabric in the color space L*, a*, and b* were measured using a spectrophotometer "CM-25d" (manufactured by Konica Minolta, Inc., measurement light source: D65). The value of L* was evaluated based on the following standard C or higher (A to C) was regarded as having no practical problem.

A: L* is equal to or more than 40 and less than 50.
B: L* is equal to or more than 50 and less than 60.
C: L* is equal to or more than 60 and less than 70.
D: L* is equal to or more than 70 and less than 80.
E: L* is equal to or more than 80 and less than 90.

<Washing Fastness>

The resulting printed fabric was subjected to a washing test by the following procedure.

A multi-fiber fabric (F35 8010) cut into a size of 1.5 cm×10 cm was sewn to the printed fabric cut into a size of 4 cm×20 cm. The remainder of the printed fabric was cut off.

Both the sample I obtained by sewing the multi-fiber fabric and the sample II obtained by cutting the remainder of the printed fabric were placed in a container containing 50 mL of a 0.1 wt % concentration aqueous detergent (hereinafter referred to as "washing liquid"). This was fixed in a desktop thermostatic shaking chamber and shaken for 30 minutes under the conditions of 50° C. and 160 rpm. The multi-fiber fabric was removed from the sample I taken out from the washing liquid and dried at room temperature for 1 day.

L*, a* and b* in the L*a*b* color space of the nylon portion of the multi-fiber fabric before and after the washing test were measured with a spectrophotometer "CM-25d" (manufactured by Konica Minolta, Inc., measurement light source: D65). Δ L*, Δ a*, and Δ b*, which are differences between the respective values before and after the washing test, were obtained, and further, a color difference Δ E*ab was calculated by the following expression. Then, the value of color difference Δ E*ab was evaluated based on the following criteria. C or higher (A to C) was regarded as having no practical problem.

$$\Delta E^*ab=\{(\Delta L^*)^2+(\Delta a^*)^2+(\Delta b^*)^2\}^{1/2} \quad \text{(Expression)}$$

A: Δ E*ab is less than 10.
B: Δ E*ab is 10 or more and less than 15.
C: Δ E*ab is 15 or more and less than 20.
D: E*ab is 20 or more and less than 25.
E: Δ E*ab is 25 or more and less than 30.

<Lightfastness>

L*, a* and b* of the obtained printed fabric in the color space L*, a*, and b* were measured using a spectrophotometer "CM-25d" (manufactured by Konica Minolta, Inc., measurement light source: D65). Thereafter, each printed fabric was irradiated at an irradiation intensity of 42 W/m$^2$ for 6 hours, and L*, a*, and b* were measured again. Δ L*, Δ a*, and Δ b*, which are differences between the respective values before and after irradiation, were obtained, and further, a color difference Δ E*ab was calculated by the following expression. Then, the value of color difference Δ E*ab was evaluated based on the following criteria. C or higher (A to C) was regarded as having no practical problem.

$$\Delta E^*\ ab=\{(\Delta L^*)^2+(\Delta a^*)^2+(\Delta b^*)^2\}^{1/2} \quad \text{(Expression)}$$

A: Δ E* ab is less than 3.
B: Δ E* ab is 3 or more and less than 5.
C: Δ E* ab is 5 or more and less than 7.
D: Δ E*ab is 7 or more and less than 10.
E: Δ E*ab is 10 or more and less than 15.

The evaluation results for each printed fabric are shown in Tables III and IV. In Comparative Example 1, the fabric was not pretreated.

TABLE III

| | FABRIC TREATMENT AGENT No. | DYEABILITY | WASHING FASTNESS | LIGHTFASTNESS |
|---|---|---|---|---|
| EXAMPLE 1 | 1 | A | B | B |
| EXAMPLE 2 | 2 | B | B | B |
| EXAMPLE 3 | 3 | B | B | B |
| EXAMPLE 4 | 4 | C | B | B |
| EXAMPLE 5 | 5 | C | B | B |
| EXAMPLE 6 | 6 | A | B | B |
| EXAMPLE 7 | 7 | A | B | B |
| EXAMPLE 8 | 8 | A | C | C |
| EXAMPLE 9 | 9 | A | B | C |

TABLE III-continued

| | FABRIC TREAT-MENT AGENT No. | DYEABILITY | WASH-ING FAST-NESS | LIGHT-FASTNESS |
|---|---|---|---|---|
| EXAMPLE 10 | 10 | A | B | B |
| EXAMPLE 11 | 11 | A | A | C |
| EXAMPLE 12 | 12 | A | C | B |
| EXAMPLE 13 | 13 | A | A | C |
| EXAMPLE 14 | 14 | A | B | A |
| EXAMPLE 15 | 15 | A | B | A |
| EXAMPLE 16 | 16 | A | B | B |
| EXAMPLE 17 | 17 | A | B | C |
| EXAMPLE 18 | 18 | A | B | A |
| EXAMPLE 19 | 19 | A | B | A |
| EXAMPLE 20 | 20 | A | B | A |
| EXAMPLE 21 | 21 | A | A | A |
| COMPARATIVE EXAMPLE 1 | — | D | D | D |
| COMPARATIVE EXAMPLE 2 | 101 | C | D | D |
| COMPARATIVE EXAMPLE 3 | 102 | B | C | D |
| COMPARATIVE EXAMPLE 4 | 103 | B | C | D |

TABLE IV

| | FABRIC TREAT-MENT AGENT No. | DYEABILITY | WASH-ING FAST-NESS | LIGHT-FASTNESS |
|---|---|---|---|---|
| EXAMPLE 22 | 22 | A | B | B |
| EXAMPLE 23 | 23 | B | B | B |
| EXAMPLE 24 | 24 | B | B | B |
| EXAMPLE 25 | 25 | C | B | B |
| EXAMPLE 26 | 26 | C | B | B |
| EXAMPLE 27 | 27 | A | B | B |
| EXAMPLE 28 | 28 | A | B | B |
| EXAMPLE 29 | 29 | A | C | C |
| EXAMPLE 30 | 30 | A | B | C |
| EXAMPLE 31 | 31 | A | B | B |
| EXAMPLE 32 | 32 | A | A | C |
| EXAMPLE 33 | 33 | A | C | B |
| EXAMPLE 34 | 34 | A | A | C |
| EXAMPLE 35 | 35 | A | B | A |
| EXAMPLE 36 | 36 | A | B | A |
| EXAMPLE 37 | 37 | A | B | B |
| EXAMPLE 38 | 38 | A | B | C |
| EXAMPLE 39 | 39 | A | B | A |
| EXAMPLE 40 | 40 | A | B | A |
| EXAMPLE 41 | 41 | A | B | A |
| EXAMPLE 42 | 42 | A | A | A |
| COMPARATIVE EXAMPLE 5 | 104 | B | C | D |

It can be seen from Examples and Comparative Examples of the present invention that the washing fastness of the printed fabric is improved by using the fabric treatment agent of the embodiment of the present invention for printing with the sublimation coloring material.

It can be seen from the examples of the present invention that when the weight average molecular weight of the aromatic heterocyclic compound I (ultraviolet absorber) is 350 or less, the washing fastness of the printed fabric is improved.

In addition, it is found that in a case where the weight average molecular weight of the aromatic heterocyclic compound II (coloring material scavenging compound) is more than 350, the washing fastness of the printed fabric is improved.

From Examples 1, 6 to 9, 22, and 27 to 30, it is found that when the content of the aromatic heterocyclic compound I (ultraviolet absorber) is in the range of 1.0 to 5.0% by mass based on the total mass of the fabric treatment agent, the washing fastness and the lightfastness of the printed fabric are improved.

From Examples 1, 10 to 13, 22, and 31 to 34, it is found that when the content of the aromatic heterocyclic compound II (coloring material scavenging compound) is in the range of 1.0 to 30.0% by mass with respect to the total mass of the fabric treatment agent, the washing fastness and the lightfastness of the printed fabric are improved.

From examples 15, 18 to 21, 36, and 39 to 42, it is found that since the aromatic heterocyclic compound I or II is a compound having a structure including a pyrazole ring, a triazole ring, or an imidazole ring, the washing fastness of the printed fabric is improved. It is understood that when the ultraviolet absorber or the coloring material scavenging compound is a compound having a structure containing a pyrazole ring, a triazole ring or an imidazole ring, the washing fastness of the printed fabric is improved.

From examples 15, 18 to 21, 36, and 39 to 42, it is found that since the aromatic heterocyclic compound I is a compound having a structure including a benzotriazole ring, the washing fastness of the printed fabric is improved. It is understood that since the ultraviolet absorber is a compound having a structure including the benzotriazole ring, the washing fastness of the printed fabric is improved.

From Examples 1 to 5 and 22 to 26, it is found that in a case where the value of the ratio (I/O value) of the inorganic value to the organic value of the organic solvent is within a range of 1 to 3, the dyeability of the printed fabric is improved.

From Examples 1, 14, 15, 22, 35, and 36, it is found that the lightfastness of the printed fabric is improved by further containing an antioxidant in the fabric treatment agent.

From Examples 14 to 17 and 35 to 38, it is found that in a case where the content of the antioxidant is within a range of 0.5% to 3.0% by mass with respect to the total mass of the fabric treatment agent, the lightfastness of the printed fabric is improved.

According to the above-described means of the present invention, it is possible to provide a fabric treatment agent, a fabric printing method, a fabric printing apparatus, and a printed fabric in which washing fastness is improved in the fabric printed with the sublimation coloring material.

An expression mechanism or an action mechanism of the effects of the present invention is not clear, but is assumed as follows.

(A) Fabric Treatment Agent Containing Aromatic Heterocyclic Compound

According to an investigation by the present inventors, in a case where the aromatic heterocyclic compound that interacts with a dye molecule is contained inside the fiber, the dye is easily fixed inside the fiber. In addition, it was found that the dyeability and the washing fastness of the printed fabric were improved.

In general, a dye molecule has a large number of aromatic rings and has a strong planar structure. The aromatic heterocyclic compound also has an aromatic heterocycle and is likely to have a planar structure. Therefore, a π-π interaction acts between the aromatic ring in the dye molecule and the aromatic ring in the aromatic heterocyclic compound, and the dye is stabilized in an arrangement in which coins are stacked. That is, since the aromatic heterocyclic compound captures the dye molecule, the dyeability is improved.

As used herein, the term "aromatic ring" refers to a cyclic structure exhibiting aromaticity (or a compound moiety containing the cyclic structure), and examples thereof include a benzene ring and an aromatic heterocycle.

In addition, as the number of aromatic rings included in the aromatic heterocyclic compound increases, the aromatic heterocyclic compound is likely to have a strong planar structure, and thus the π-π interaction is likely to strongly act. As a result, the ability to capture dye molecules is enhanced, and the dyeability and the washing fastness are considered to be improved.

However, by using an aromatic heterocyclic compound having a large number of aromatic rings, the dyeability reach sufficient performance, but there is room for further improvement in washing fastness.

As a result of cross-sectional observation of the printed fabric after washing, the inventors of the present invention have found that an aromatic heterocyclic compound having a large number of aromatic rings captures dye molecules in an outer portion of a fiber cross-section or a fiber surface.

Therefore, in order to further improve the washing fastness, that is, in order to prevent the dye molecule from being detached from the fiber by washing, it is necessary to confine the dye molecule also in the inner part of the fiber so that the dye molecule is less likely to be detached. For this purpose, it is preferred to arrange the aromatic heterocyclic compound more to the inner portion of the fiber, and it is preferred to use an aromatic heterocyclic compound having a smaller molecular weight in combination.

Therefore, the aromatic heterocyclic compound preferably has a structure having a large number of aromatic rings from the viewpoint of dyeability. As the aromatic heterocyclic compound, in view of washing fastness, it is preferable to use the former in combination with a compound having a small molecular weight.

In the present invention, two kinds of aromatic heterocyclic compounds having different weight average molecular weights are used in combination. Thus, the aromatic heterocyclic compound having a relatively small molecular weight can be arranged in a more inner part (inner side) of the fiber, and the aromatic heterocyclic compound having a relatively large molecular weight can be arranged on the outer side thereof. As a result, it is considered that both the dyeability and the washing fastness can be improved.

(B) Fabric Treatment Agent Containing Coloring Material Scavenging Compound and Ultraviolet Absorber Further, the present inventors have studied from the viewpoint of lightfastness. When the coloring material scavenging compound having a function of trapping the coloring material (dye molecule) and the ultraviolet absorber are contained in the inside of the fiber, the dye is easily fixed in the inside of the fiber. In addition, it was found that the dyeability and the lightfastness of the printed fabric were improved.

Even in a case where only the coloring material scavenging compound was included inside the fiber and the ultraviolet absorber was not included, the lightfastness of the printed fabric was sufficient, but there was room for improvement. As a result of investigation by the present inventors, it has been found that this is because some sublimation coloring materials and coloring material scavenging compounds are decomposed by ultraviolet rays.

Therefore, it is considered that by using an ultraviolet absorber in combination, the decomposition of the sublimation coloring material and the coloring material scavenging compound by ultraviolet rays can be suppressed, and thus the lightfastness can be improved.

Furthermore, it has also been found that the washing fastness is improved also in the method.

The expression mechanism or action mechanism of the effect of the washing fastness by the above method is not clarified. However, many compounds used as an ultraviolet absorber have a large number of aromatic rings, and it is conceivable that the same effects as those obtained by using the above-described aromatic heterocyclic compound are obtained.

Although embodiments of the present invention have been described and illustrated in detail, the disclosed embodiments are made for purposes of illustration and example only and not limitation. The scope of the present invention should be interpreted by terms of the appended claims.

The invention claimed is:

1. A fabric treatment agent used for printing with a sublimation coloring material, comprising:

at least an aromatic heterocyclic compound I and an aromatic heterocyclic compound II, wherein a weight average molecular weight of the aromatic heterocyclic compound I is smaller than a weight average molecular weight of the aromatic heterocyclic compound II.

2. The fabric treatment agent according to claim 1, wherein the weight average molecular weight of the aromatic heterocyclic compound I is 350 or less.

3. The fabric treatment agent according to claim 1, wherein the weight average molecular weight of the aromatic heterocyclic compound II is greater than 350.

4. The fabric treatment agent according to claim 1, wherein a content of the aromatic heterocyclic compound I is within a range of 1.0 to 5.0% by mass with respect to a total mass of the fabric treatment agent.

5. The fabric treatment agent according to claim 1, wherein a content of the aromatic heterocyclic compound II is within a range of 1.0 to 30.0% by mass with respect to a total mass of the fabric treatment agent.

6. The fabric treatment agent according to claim 1, wherein the aromatic heterocyclic compound I or the aromatic heterocyclic compound II is a compound having a structure including a pyrazole ring, a triazole ring, or an imidazole ring.

7. The fabric treatment agent according to claim 6, wherein the aromatic heterocyclic compound I is a compound having a structure including a benzotriazole ring.

8. The fabric treatment agent according to claim 1, wherein the aromatic heterocyclic compound II is a coloring material scavenging compound and the aromatic heterocyclic compound I is an ultraviolet absorber.

9. The fabric treatment agent according to claim 1, further comprising an organic solvent.

10. The fabric treatment agent according to claim 9, wherein a value (I/O value) of a ratio between an inorganic value and an organic value of the organic solvent is in a range of 1 to 3.

11. The fabric treatment agent according to claim 1, further comprising an antioxidant.

12. The fabric treatment agent according to claim 11, wherein content of the antioxidant is within a range of 0.5 to 3.0% by mass with respect to a total mass of the fabric treatment agent.

13. A fabric printing method to print on a fabric with a sublimation coloring material, the method comprising:

applying an aromatic heterocyclic compound I to the fabric;

applying an aromatic heterocyclic compound II to the fabric; and applying the sublimation coloring material to the fabric, wherein a weight average molecular weight of the aromatic heterocyclic compound I is smaller than a weight average molecular weight of the aromatic heterocyclic compound II.

14. A fabric printing method to print on a fabric with a sublimation coloring material, the method comprising:

applying the fabric treatment agent according to claim 1 to the fabric; and applying the sublimation coloring material to the fabric.

15. The fabric printing method according to claim 14, wherein the fabric contains a cellulose fiber.

16. The fabric printing method according to claim 14, wherein a method of applying the sublimation coloring material to the fabric is a sublimation transfer method.

17. A fabric printing apparatus to print on a fabric with a sublimation coloring material, the fabric printing apparatus comprising:

a section that applies the fabric treatment agent according to claim 1 to the fabric; and a section that applies the sublimation coloring material to the fabric.

18. The fabric printing apparatus according to claim 17, wherein a method of applying the sublimation coloring material to the fabric is a sublimation transfer method.

19. The fabric treatment agent according to claim 1, wherein each of the aromatic heterocyclic compound I and the aromatic heterocyclic compound II contains a structure including a triazine ring, a pyrazolone ring, a pyrazole ring, a triazole ring, or an imidazole ring.

20. The fabric treatment agent according to claim 1, wherein the aromatic heterocyclic compound II is a coloring material scavenging compound having an Rf value of 0.7 or less obtained by a paper chromatography method comprising:

Procedure 1: a cellulose filter paper is impregnated with a solution including 10% by mass of the coloring material scavenging compound and then dried to prepare a carrier;

Procedure 2: a tetrahydrofuran solution including 0.1% by mass of the sublimation coloring material is spotted on the carrier and then dried to prepare a development sample;

Procedure 3: the development sample is developed with acetonitrile at 25° C. for 3 minutes; and Procedure 4: the Rf value is obtained from the following expression: Rf value=development distance of sublimation coloring material/development distance of acetonitrile.

* * * * *